US012692644B2

(12) United States Patent
Xu et al.

(10) Patent No.: US 12,692,644 B2
(45) Date of Patent: Jul. 28, 2026

(54) WASHING MACHINE AND CONTROL METHOD THEREOF

(71) Applicants: QINGDAO HAIER WASHING MACHINE CO., LTD., Qingdao (CN); HAIER SMART HOME CO., LTD., Qingdao (CN)

(72) Inventors: Sheng Xu, Qingdao (CN); Peishi Lv, Qingdao (CN); Yanfen Lv, Qingdao (CN); Kai Liu, Qingdao (CN)

(73) Assignees: QINGDAO HAIER WASHING MACHINE CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 187 days.

(21) Appl. No.: 18/579,621

(22) PCT Filed: Jul. 8, 2022

(86) PCT No.: PCT/CN2022/104631
§ 371 (c)(1),
(2) Date: Jan. 16, 2024

(87) PCT Pub. No.: WO2023/284646
PCT Pub. Date: Jan. 19, 2023

(65) Prior Publication Data

US 2024/0337059 A1 Oct. 10, 2024

(30) Foreign Application Priority Data

Jul. 13, 2021 (CN) ..... 202110789586.4
Jul. 13, 2021 (CN) ..... 202110789651.3

(51) Int. Cl.
*D06F 39/10* (2006.01)
*D06F 33/43* (2020.01)
(Continued)

(52) U.S. Cl.
CPC ..... *D06F 39/10* (2013.01); *D06F 33/43* (2020.02); *D06F 39/083* (2013.01); *D06F 39/08* (2013.01);
(Continued)

(58) Field of Classification Search
CPC ..... D06F 33/43; D06F 39/08; D06F 39/083; D06F 39/10; D06F 2103/14; D06F 2105/06; D06F 2105/08; D06F 2105/34
See application file for complete search history.

(56) References Cited

U.S. PATENT DOCUMENTS

2020/0256003 A1 8/2020 Hansson
2020/0270795 A1* 8/2020 Zarcone ..... D06F 34/22

FOREIGN PATENT DOCUMENTS

CN 104153162 A 11/2014
CN 104278492 A 1/2015
(Continued)

OTHER PUBLICATIONS

Machine translation of WO 2017/043290 A1 to Iwasaki. (Year: 2017).*
(Continued)

*Primary Examiner* — Joseph L. Perrin
(74) *Attorney, Agent, or Firm* — Panitch Schwarze Belisario & Nadel LLP

(57) ABSTRACT

A washing machine and a control method thereof, the washing machine includes: a water container; a filtering device, communicating with the water container and configured to filter the water in the water container, the filtering device is provided with a discharge outlet for discharging filtered impurities outward; and a recovery device, separately arranged with the filtering device and communicating with the discharge outlet of the filtering device for collecting the discharged filtered impurities. The filtered impurities are
(Continued)

collected by setting a recovery device, so that the filtered impurities are not directly discharged along with the drainage water of the washing machine. At the same time, the recovery device and the filtering device are separately arranged, and the filtered impurities are discharged into the recovery device without being accumulated in the filtering device, thus avoiding the influence on the filtering efficiency.

19 Claims, 8 Drawing Sheets

(51) Int. Cl.

| | |
|---|---|
| ***D06F 39/08*** | (2006.01) |
| *D06F 103/14* | (2020.01) |
| *D06F 105/06* | (2020.01) |
| *D06F 105/08* | (2020.01) |
| *D06F 105/34* | (2020.01) |

(52) U.S. Cl.
CPC ..... *D06F 2103/14* (2020.02); *D06F 2105/06* (2020.02); *D06F 2105/08* (2020.02); *D06F 2105/34* (2020.02)

(56) References Cited

FOREIGN PATENT DOCUMENTS

| | | | |
|---|---|---|---|
| CN | 104805651 | A | 7/2015 |
| CN | 105088697 | A | 11/2015 |
| CN | 207435753 | U | 6/2018 |
| CN | 109957937 | A | 7/2019 |
| CN | 217266428 | U | 8/2022 |
| CN | 217266429 | U | 8/2022 |
| CN | 217266430 | U | 8/2022 |
| CN | 217266431 | U | 8/2022 |
| DE | 102016004326 | A1 | 10/2017 |
| EP | 3385439 | A1 | 10/2018 |
| JP | H06142393 | A | 5/1994 |
| JP | 2000189693 | A | 7/2000 |
| JP | 2007181560 | A | 7/2007 |
| JP | 2016536063 | A | 11/2016 |
| WO | 2017043290 | A1 | 3/2017 |

OTHER PUBLICATIONS

Machine translation of DE 102016004326 A1 to Wessel et al. (Year: 2017).*

Extended European Search Report issued on Jul. 11, 2024, by the European Patent Office in corresponding EP Application No. 22841282.1 (9 pages).

Office Action (Examination Report) issued on Feb. 11, 2025, by the Australian Patent Office in corresponding AU Application No. 2022310063 (4 pages).

Office Action issued on Aug. 1, 2025, by the State Intellectual Property Office of People's Republic of China in corresponding CN Application No. 202311014365.5, and English translation of the Office Action (10 pages).

Office Action issued on Feb. 18, 2025, by the Japanese Patent Office in corresponding JP Application No. 2024-501493 (English translation) (6 pages).

International Search Report (PCT/ISA/210) with translation and Written Opinion (PCT/ISA/237) mailed on Oct. 13, 2022, by the China National Intellectual Property Administration as the International Searching Authority for International Application No. PCT/CN2022/104631. (13 pages).

* cited by examiner

WASHING MACHINE AND CONTROL METHOD THEREOF

TECHNICAL FIELD

The present disclosure belongs to the technical field of washing machines, and in particular, relates to a washing machine and a control method thereof.

BACKGROUND

In the process of washing clothes by a washing machine, due to the friction between the clothes and the clothes, as well as between the clothes and the washing machine itself, the thread scraps of the clothes will fall off and are mixed into the washing water. If the thread scraps in the washing water cannot be removed, they are likely to attach to the surface of the clothes after washing, which will affect the washing effect of the clothes. For this reason, the existing washing machine is equipped with a filter for filtering the thread scraps, and the washing water is circulated to pass through the filter during the washing process to remove the thread scraps from the washing water.

The filter of the existing washing machine is generally arranged in an inner drum or a drain pump, which is used for filtering the thread scraps and sundries in the washing water. However, after the washing machine is used for a long time, the filter will be filled with the thread scraps and sundries, which will affect the filtering effect of the filter, cause the blockage of the drain valve/pump, and easily breed bacteria, so it is necessary to clean it in time, otherwise it will cause pollution of the washing water, cause secondary pollution to the clothes, and affect the health of users. However, most washing machines require users to take off the filter and clean it manually, which is inconvenient to operate.

On the other hand, due to the blockage of the filter holes on the filter by the thread scraps in some filters, the aperture of the filter holes is usually set to be large, but this also leads to the fact that some fine thread scraps on the clothes cannot be filtered, resulting in this part of thread scraps sticking to clothes and affecting the user experience. At the same time, a part of thread scraps will be discharged along with the water flow and enter the ecological cycle, which will eventually affect the human health.

Due to the above problems, the prior art provides a filter capable of self-cleaning, in which the thread scraps and the like in the filter fall off by flushing or vibrating, and then flow into a drainage pipeline of the washing machine together with flushing water to be discharged from the washing machine. However, in the above solution, because the flushed thread scraps directly flow into the drainage water flow of the washing machine, they will still enter the ecological cycle, posing a threat to the human health.

In view of this, the present disclosure is proposed.

SUMMARY

In order to solve the above problems, the first inventive objective of the disclosure is to provide a washing machine, which can collect filter impurities, avoid the fine thread scraps in the washing machine being directly discharged along with the water flow, and avoid the problem that the filter impurities accumulate in the filtering device and affect the filtering efficiency. In particular, the disclosure adopts the following technical solution:

a washing machine, includes:

a water container;

a filtering device, communicating with the water container and configured to filter the water in the water container, wherein the filtering device is provided with a discharge outlet for discharging filtered impurities outward; and a recovery device, separately arranged with the filtering device and communicating with the discharge outlet of the filtering device for collecting the discharged filtered impurities.

Further, a discharge pipeline is also included, and one end of the discharge pipeline is connected with the discharge outlet of the filtering device, and the other end communicates with the recovery device; and preferably, a discharge control valve configured to control on-off of the discharge pipeline is arranged on the discharge pipeline.

Further, the filtering device includes:

a filtering cavity, the discharge outlet being arranged thereon, and a water inlet communicating with the water container being further arranged thereon; and a filtering mechanism, rotatably arranged within the filtering cavity and dividing the inside of the filtering cavity into an outer cavity and an inner cavity; wherein the water inlet and the discharge outlet both communicate with the outer cavity, and the discharge outlet is arranged at a bottom region of the filtering cavity and is connected with the discharge pipeline.

Further, the recovery device includes:

a housing, provided with a recovery chamber inside; and a filtering assembly, arranged within the recovery chamber and dividing the recovery chamber into a first chamber and a second chamber; wherein the discharge outlet of the filtering device communicates with the first chamber, and the sewage carrying the filtered impurities enters the first chamber, is filtered by the filtering assembly and enters the second chamber, and the filtered impurities are collected in the first chamber.

Further, the filtering assembly includes a filter screen horizontally arranged at a certain height within the recovery chamber, and the filter screen divides the recovery chamber into a first chamber and a second chamber distributed up and down.

Further, the housing is insertably/extractably mounted on the washing machine, and an upper side of the housing is provided with an opening; and preferably, the second chamber communicates with a main water inlet pipe of the washing machine through a pipeline; or, the second chamber communicates with a drainage waterway of the washing machine through a pipeline.

A second objective of the present disclosure is to provide a washing machine and a control method thereof, so as to achieve the objective of preventing the filtered impurities cleaned up in the filtering device from being directly discharged with the drainage of the washing machine, and in particular, the following technical solution is adopted:

a washing machine, includes:

a water container, a circulation filtering pipeline, a water inlet end and a water outlet end of which respectively communicating with the water container, and a circulation pump being arranged thereon;

a filtering device, arranged on the circulation filtering pipeline, provided with a discharge outlet for discharging filtered impurities outward;

a recovery device, communicating with the discharge outlet of the filtering device through a discharge pipeline, and configured to collect the discharged filtered impurities; and a discharge control valve, arranged on the discharge pipeline, and configured to control on-off of the discharge pipeline.

Further, the recovery device includes:

a housing, provided with a recovery chamber inside; and a filtering assembly, arranged within the recovery chamber and dividing the recovery chamber into a first chamber and a second chamber; wherein the discharge pipeline communicates with the first chamber, and the sewage carrying the filtered impurities enters the first chamber, is filtered by the filtering assembly and enters the second chamber, and the filtered impurities are collected in the first chamber.

Further, a three-way structure is arranged between a water outlet end of the circulation pump and the water outlet end of the circulation filtering pipeline, and the three-way structure is connected with an outward discharge pipeline for discharging water to the outside of the washing machine; and the filtering device is arranged between the three-way structure and the water outlet end of the circulation filtering pipeline.

Further, the three-way structure includes a switching mechanism for controlling one of the filtering device and the outward discharge pipeline to communicate with the water outlet end of the circulation pump.

Further, a water return control valve is arranged between the filtering device and the water outlet end of the circulation filtering pipeline, which is configured to control on-off of the circulation filtering pipeline.

Further, the filtering device includes:

a filtering cavity, a water inlet, a filtered water outlet and a discharge outlet being arranged thereon, wherein the water inlet and the filtered water outlet are connected on the circulation filtering pipeline;

a filtering mechanism, rotatably arranged in the filtering cavity; and a driving mechanism, configured to drive the filtering mechanism to rotate in the filtering cavity; and preferably, an orientation of the filtered water outlet is parallel to an axial direction of the filtering mechanism;

more preferably, the axis of the filtering mechanism is horizontally arranged, the orientation of the filtered water outlet is horizontal, the water inlet is vertically arranged upward, and the discharge outlet is vertically arranged downward; or the axis of the filtering mechanism is vertically arranged, the filtered water outlet is vertically arranged downward, and orientations of the water inlet and the discharge outlet are opposite and are both parallel to the horizontal direction.

The control method of the washing machine as described above performs a discharge operation, which includes: opening the discharge control valve to open the discharge pipeline, and discharging the sewage carrying the filtered impurities in the filtering device into the recovery device.

Further, a circulation filtering operation is performed: closing the discharge control valve, turning on the circulation pump to introduce the water in the water container into the circulation filtering pipeline, and making the water return to the water container after removing the filtered impurities by the filtering device.

Further, a water return control valve is arranged between the filtering device and the water outlet end of the circulation filtering pipeline for controlling on-off of the circulation filtering pipeline;

the control method also includes a self-cleaning operation, which includes: closing the water return control valve, opening the discharge control valve to open the discharge pipeline, turning on the circulation pump to introduce the water in the water container into the filtering device, and discharging the water to the recovery device after cleaning the filtering device; and preferably, the filtering device includes a filtering cavity, a filtering mechanism and a driving mechanism, and the self-cleaning operation further includes: controlling the driving mechanism to drive the filtering mechanism to rotate in the filtering cavity.

Further, the self-cleaning operation and/or the discharge operation is performed at least once in a complete washing program.

A third objective of the disclosure is to provide a washing machine and a control method thereof. A filtering device can discharge accumulated filtered impurities into a drainage waterway to realize discharging, and the drainage water of the washing machine itself can be directly discharged without passing the filtering device, which does not affect the drainage efficiency. In particular, the disclosure adopts the following technical solution:

a washing machine, includes:

a water container, a water container water outlet being arranged thereon;

a drainage waterway, a water inlet end of which being connected with the water container water outlet and configured to discharge water to the outside of the washing machine;

a filtering device, communicating with the water container to receive the water in the water container for filtering, and provided with a discharge outlet for discharging filtered impurities;

a discharge pipeline, a water inlet end of which is connected with the discharge outlet, and a water outlet end of which is connected with the drainage waterway; and a discharge control valve, arranged on the discharge pipeline and configured to control on-off of the discharge pipeline.

Further, when the discharge control valve is opened, the discharge pipeline is unidirectionally opened from the discharge outlet to the drainage waterway.

Further, the discharge pipeline includes a sewage discharge section which vertically extends upward for a certain length, and an upper end of the sewage discharge section is connected with the drainage waterway; the discharge control valve is arranged on the sewage discharge section; and preferably, the discharge control valve is arranged close to the upper end of the sewage discharge section.

Further, the drainage waterway includes an upper drainage pipe extending vertically for a certain length, in which the drainage water flow flows upwards; the upper end of the sewage discharge section is connected with a lower end of the upper drainage pipe.

Further, a circulation pump is arranged between the water container water outlet and the water outlet end of the discharge pipeline on the drainage waterway, and a switching device is arranged between a water outlet end of the circulation pump and the water outlet end of the discharge pipeline; and the switching device is connected with the filtering device, and controls one of a water inlet of the filtering device and the water outlet end of the drainage waterway to communicate with the water outlet end of the circulation pump.

Further, a bottom region of the water container is provided with a water container water return port, and the filtering device is provided with a filtered water outlet for discharging the filtered water; the filtered water outlet communicates with the water container water return port through a water return pipeline, and a water return control valve for controlling on-off of the water return pipeline is arranged on the water return pipeline.

Further, the water container water outlet and the water container water return port are both arranged on a container wall of the water container and are located in the bottom region of the water container.

Further, the water container water outlet is arranged close to a container mouth of the water container, and the water container water return port is arranged close to the container bottom of the water container; or the water container water outlet is arranged near the container bottom of the water container, and the water container water return port is arranged near the container mouth of the water container.

A control method of the washing machine performs a discharge operation, including: opening the discharge control valve to open the discharge pipeline, and discharging the sewage carrying the filtered impurities in the filtering device into the drainage waterway.

Further, in a complete washing program, the discharge operation is performed at least once; and preferably, the washing machine performs the discharge operation in the drainage stage of each dewatering process; or, the washing machine performs the discharge operation in the drainage stage of the final dewatering process.

After adopting the technical solution, the disclosure has the following beneficial effects compared with the prior art.

In the disclosure, the filtered impurities are collected by setting a recovery device, so that the filtered impurities are not directly discharged along with the drainage water of the washing machine, thus reducing the possibility that the fine thread scraps in the filtered impurities enter the ecological cycle along with the water flow and reducing the influence on the ecological environment and human health. At the same time, the recovery device and the filtering device are separately arranged, and the filtered impurities are discharged into the recovery device without being accumulated in the filtering device, thus avoiding the influence on the filtering efficiency.

In the disclosure, the filtering device is provided with two water outlets: a filtered water outlet and a discharge outlet, which respectively communicate with the water container and the recovery device through pipelines for discharging the filtered water and the sewage carrying the filtered impurities. Control valves are respectively arranged to control the filtering device to communicate with the water container or the recovery device, which can ensure that the water entering the filtering device flows out from the corresponding water outlet, thus controlling whether the filtering device performs a circulation filtering operation or a self-cleaning operation/discharge operation.

In the disclosure, a three-way structure connected with an outward discharge pipeline is arranged between the circulation pump and the filtering device in the circulation filtering pipeline, and the switching mechanism in the three-way structure controls one of the filtering device and the outward discharge pipeline to communicate with the circulation pump. The washing machine does not need to set two independent waterways for circulation filtering and drainage respectively, and can realize two functions of circulation filtering of the washing water and outward drainage through one circulation pump at the same time, thus simplifying the internal waterway structure of the washing machine and saving space.

In the washing machine of the disclosure, the filtering mechanism in the filtering device can rotate in the filtering cavity under the driving of the driving mechanism, and the filtered impurities attached to the outer surface of the filtering mechanism can be peeled off from the filtering mechanism under the centrifugal force generated by rotation and the impact force of the agitated water flow in the filtering cavity, thereby realizing the self-cleaning function of the filtering device and having high cleaning efficiency of the filtered impurities.

In the disclosure, the filtered impurities accumulated in the filtering device during the filtering process can be discharged from the discharge outlet and discharged into the drainage waterway of the washing machine along the discharge pipeline, and then discharged from the washing machine along the drainage waterway, thus realizing the automatic cleaning of the filtering device and saving the trouble of manual cleaning of the filtering device by users. The water inlet end of the drainage waterway is directly connected with the water container. When the filtering device is not needed to be cleaned, the water in the water container can be directly discharged along the drainage waterway without passing through the filtering device, and the drainage efficiency is higher.

In the disclosure, the discharge control valve is arranged as a one-way valve which can be opened/closed, so that the sewage in the discharge pipeline can be prevented from flowing backwards, or the drainage water flow in the drainage waterway can be prevented from flowing to the filtering device along the discharge pipeline. The drainage waterway is provided with a vertical upper drainage pipe, the sewage discharge section of the discharge pipeline is connected with the lower end of the upper drainage pipe, and the discharge control valve is arranged at the upper end of the sewage discharge section, that is, close to the connection between the sewage discharge section and the drainage waterway, so as to effectively prevent the drainage water flow in the drainage waterway from entering the discharge pipeline.

In the disclosure, the switching device is arranged on the drainage waterway and connected with the filtering device, the water flow direction of the water outlet from the water container can be controlled by the switching device, and then two purposes of guiding water to the filtering device and discharging water outward can be realized by adopting one circulation pump, thus simplifying the internal waterway structure of the washing machine and saving installation space.

In the disclosure, the bottom region of the water container is provided with the water container water return port, the water filtered by the filtering device is returned to the water container from the water container water return port, and the water flow in the water container can be strengthened while the water is returned, thus improving the washing effect. The water container water outlet and the water container water return port are respectively arranged near the container mouth and the container bottom, so that the distance between them is maximized as much as possible, which is beneficial to the formation of a water flow flowing from the container mouth to the container bottom or from the container bottom to the container mouth in the water container, and the water flow covers a wider range, and the effect of strengthening the water flow is more obvious.

Specific embodiments of the disclosure are described in further detail below with reference to the accompanying drawings.

BRIEF DESCRIPTION OF THE DRAWINGS

The accompanying drawings are incorporated in and constitute a part of this disclosure to provide a further understanding of the disclosure, illustrative embodiments of the disclosure and the description thereof are provided for the purpose of explanation of the disclosure, and do not constitute an undue limitation of the present disclosure. Apparently, the accompanying drawings in the following description are merely some embodiments, for those of ordinary skill in the art, on the premise of paying no creative labor, other drawings can also be obtained according to these accompanying drawings. In the drawings.

Figure 1:
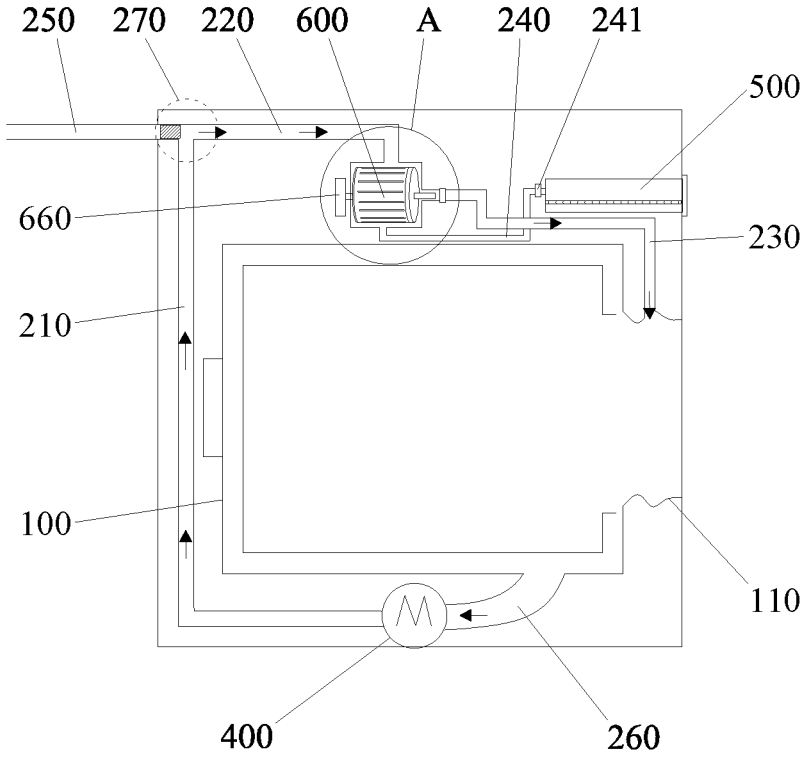
FIG. 1 is a structural schematic diagram of a washing machine in embodiments one to three of the present disclosure.

In the drawing: 100, water container; 110, window gasket; 210, drainage pipeline; 220, circulation pipeline; 230, water return pipeline; 231, water return control valve; 240, discharge pipeline; 241, discharge control valve; 250, outward discharge pipeline; 260, water container drainage pipe; 270, switching device; 280, drainage waterway; 281, water container discharge pipe; 282, circulation pipe; 283, connecting pipe; 284, upper drainage pipe; 285, outward discharge pipe; 400, circulation pump; 500, recovery device; 501, filtered impurities; 510, housing; 520, filtering assembly; 531, first chamber; 532, second chamber;

600, filtering device; 601, first limiting surface; 602, second limiting surface; 603, third limiting surface; 604, fourth limiting surface; 605, fifth limiting surface; 606, sixth limiting surface; 610, filtering cavity; 6101, water inlet; 6102, filtered water outlet; 6103, discharge outlet; 6104, mounting port; 611, sealing support; 612, sleeve portion; 613, reinforcing bar; 620, filtering mechanism; 621, water outlet connector; 622, rotation support; 623, filter screen support; 624, motor mounting portion; 625, filter screen; 631, first bearing; 632, second bearing; 641, first sealing member; 642, second sealing member; 643, third sealing member; 650, filtering cavity flange; 651, connecting portion; 652, inserting portion; 653, through opening; 660, driving mechanism.

It should be noted that these drawings and written description are not intended to limit the scope of the inventive concept in any way, but rather to illustrate the inventive concept for those skilled in the art by reference to specific embodiments.

DETAILED DESCRIPTION

In order to make the objectives, technical solutions and advantages of the embodiments of the present disclosure clearer, the technical solutions in the embodiments will be clearly and completely described below in conjunction with the accompanying drawings in the embodiments of the present disclosure, the following embodiments are used to illustrate the present disclosure, but are not used to limit the scope of the present disclosure.

In the description of the disclosure, it should be noted that, the terms "upper", "lower", "front", "rear", "left", "right", "vertical", "inner", "outer" and the like indicate an orientation or positional relationship based on the orientation or positional relationship shown in the drawings, only for ease of description of the disclosure and for simplicity of description, it is not intended to indicate or imply that the device or element referred to must have a particular orientation, be constructed and operate in a particular orientation, and therefore should not be construed as limiting the disclosure.

In the description of the present disclosure, it should be noted that, unless expressly specified and limited otherwise, the terms "mounted", "connected" and "connecting" should be understood in a broad sense. For example, it can be fixed connection, detachable connection or integrated connection; it can be mechanical connection or electrical connection; and it can be direct connection or indirect connection through intermediate media. For those of ordinary skill in the art, the specific meaning of the above-mentioned terms in the present disclosure can be understood in specific situations.

Embodiment 1

As shown in FIGS. 1 to 5, the washing machine according to the present embodiment includes:

a water container 100;

a filtering device 600, communicating with the water container 100 and configured to filter the water in the water container 100, wherein the filtering device 600 is provided with a discharge outlet 6103 for discharging filtered impurities 501 outward; and a recovery device 500, separately arranged with the filtering device 600 and communicating with the discharge outlet 6103 of the filtering device 600 for collecting the discharged filtered impurities 501.

In the above solution, the water container 100 communicates with the filtering device 600, and the water in the water container 100 can pass through the filtering device 600 for filtering, thereby removing the filtered impurities from the water. The filtering device 600 is provided with a discharge outlet 6103, and the filtered impurities 501 remaining in the filtering device 600 after filtering can be discharged through the discharge outlet 6103, a user does not need to remove the filtering device 600 for manual cleaning, and the use is convenient.

In the washing machine, the recovery device 500 is separately arranged with the filtering device 600 and communicates with the discharge outlet 6103 of the filtering device 600, and the filtered impurities 501 can be discharged into the recovery device 500 without being accumulated inside the filtering device 600, thereby preventing the filtering efficiency from being affected. Meanwhile, the recovery device 500 collects the filtered impurities 501, so that the filtered impurities 501 are not directly discharged with the drainage water flow of the washing machine, and the problem that fine thread scraps in the filtered impurities 501 are discharged with the water flow and enter into ecological cycle, thereby causing hazards to ecological environment and human health is avoided.

In particular, the washing machine is provided with a circulation filtering pipeline, a water inlet end and a water outlet end of which respectively communicate with the water container 100, a circulation pump 400 is arranged thereon, and the filtering device 600 is arranged on the circulation filtering pipeline.

In the embodiment, the water container 100 communicates with the circulation filtering pipeline to form a circulation filtering loop, and the washing water contained in the water container 100 is introduced into the circulation filtering pipeline by the circulation pump 400, filtered impurities 501 such as thread scraps are removed from the water by the filtering device 600, and then the water is returned to the water container 100. The washing water is continuously circulated to pass through the filtering device 600 by the circulation pump 400 during the washing of the clothes, thereby reducing the amount of thread scraps in the washing water, and improving the washing effect of the clothes.

The washing machine is also provided with a discharge pipeline 240 for connecting the recovery device 500 with the discharge outlet 6103 of the filtering device 600. In particular, one end of the discharge pipeline 240 is connected with the discharge outlet 6103 of the filtering device 600, and the other end communicates with the recovery device 500. A discharge control valve 241 configured to control the on-off of the discharge pipeline 240 is arranged on the discharge pipeline 240.

When the washing water is circulated in the circulation filtering loop for filtering, the discharge control valve 241 is closed to break the communication between the discharge outlet 6103 and the recovery device 500, ensuring that the washing water is continuously circulated along the circulation filtering pipeline, i.e., the washing water entering the filtering device 600 does not flow out through the discharge outlet 6103 into the recovery device 500.

The filtering device of the embodiment includes: a filtering cavity 610, the discharge outlet 6103 being arranged thereon, and a water inlet 6101 communicating with the water container 100 being further arranged thereon; and a filtering mechanism 620, rotatably arranged within the filtering cavity 610 and dividing the inside of the filtering cavity 610 into an outer cavity and an inner cavity.

The water inlet 6101 and the discharge outlet 6103 both communicate with the outer cavity, and the discharge outlet 6103 is arranged at a bottom region of the filtering cavity 610 and is connected with the discharge pipeline 240.

In the above solution, water in the water container 100 enters the outer cavity of the filtering cavity 610 through the water inlet 6101 under the driving of the circulation pump 400, the filtered impurities 501 are blocked by the filtering mechanism 620 to be filtered, and the filtered water enters the inner cavity and is returned to the water container 100. The filtered impurities 501 are attached to an outer wall of the filtering mechanism 620 or remain in the outer cavity, and when the discharge control valve 241 is opened, the discharge pipeline 240 is opened. The discharge outlet 6103 is arranged at the bottom of the filtering cavity 610, and the filtered impurities 501 are more easily discharged sufficiently, and the residual of the filtered impurities 501 inside the filtering cavity 610 is reduced.

In a further solution of the embodiment, the recovery device 500 specifically includes:

a housing 510, a recovery chamber being arranged inside; and a filtering assembly 520, arranged within the recovery chamber and dividing the recovery chamber into a first chamber 531 and a second chamber 532; wherein the discharge pipeline 240 communicates with the first chamber 531, and the sewage carrying the filtered impurities 501 enters the first chamber 531, is filtered by the filtering assembly 520 and enters the second chamber 532, and the filtered impurities 501 are collected in the first chamber 531.

In particular, the filtering assembly 520 may be a frame horizontally arranged at a certain height within the recovery chamber and a filter screen laid on the frame, which divide the recovery chamber into a first chamber 531 and a second chamber 532 distributed up and down. After the sewage carrying the filtered impurities 501 enters the first chamber 531, the water can pass through the filtering assembly 520 into the second chamber 532, and the filtered impurities 501 are blocked by the filter screen and remain on an upper surface of the filtering assembly 520. The housing 510 is insertably/extractably mounted on the washing machine and has an opening on an upper side thereof, so that the user can extract the housing 510 from the washing machine to clean the filtered impurities 501 attached to the upper surface of the filtering assembly 520.

Preferably, the second chamber 532 communicates with a main water inlet pipe of the washing machine through a pipeline so that the fresh water from which the filtered impurities 501 are filtered can be introduced into the water container 100 for reuse. Or, the second chamber 532 communicates with a drainage waterway of the washing machine through a pipeline, and the water from which the filtered impurities 501 are filtered is mixed into a drainage water flow of the washing machine and discharged from the washing machine together. Since the filtered impurities 501 have been removed while passing through the filtering assembly 520, there is no situation where the filtered impurities 501, particularly the fine thread scraps therein, are discharged with the drainage water flow, thereby avoiding the problem that the fine thread scraps are mixed into the ecological cycle.

In the embodiment, a three-way structure is arranged between a water outlet end of the circulation pump 400 and the water outlet end of the circulation filtering pipeline, and the three-way structure is connected with an outward discharge pipeline 250 for discharging water to the outside of the washing machine.

The filtering device 600 is arranged between the three-way structure and the water outlet end of the circulation filtering pipeline.

Further, the three-way structure is a switching device 270 for controlling one of the filtering device 600 and the outward discharge pipeline 250 to communicate with the water outlet end of the circulation pump 400, including:

- a water inlet, communicating with the water outlet end of the circulation pump 400;
- a first water outlet, communicating with the filtering device 600;
- a second water outlet, communicating with the outward discharge pipeline 250; and
- a switching mechanism, configured to control one of the first water outlet and the second water outlet to communicate with the water inlet.

In particular, the circulation filtering pipeline includes:

- a water container drainage pipe 260, connecting the water container 100 with the water inlet of the circulation pump 400;
- a drainage pipeline 210, one end being connected with the water outlet of the circulation pump 400 and the other end being connected with the water inlet of the switching device 270;
- a circulation pipeline 220, one end being connected with the first water outlet of the switching device 270 and the other end being connected with the water inlet 6101 of the filtering device 600; and
- a water return pipeline 230, one end being connected with the filtered water outlet 6102 of the filtering device 600 and the other end being connected with the water container 100 to deliver filtered water to the water container 100.

The water inlet end of the outward discharge pipeline 250 is connected with the second water outlet of the switching device 270, and the water outlet end extends to the outside of the washing machine.

In detail, the filtering device 600 is disposed above the water container 100, the circulation pipeline 220 and the water return pipeline 230 are also arranged above the water container 100, and the water outlet end of the water return pipeline 230 is connected with the window gasket 110 to communicate with the water container 100. The circulation pump 400 is arranged below the water container 100 and communicates with the water container 100 through the water container drainage pipe 260, and the drainage pipeline 210 transfers the washing water from bottom to top by the circulation pump 400.

Figure 4:
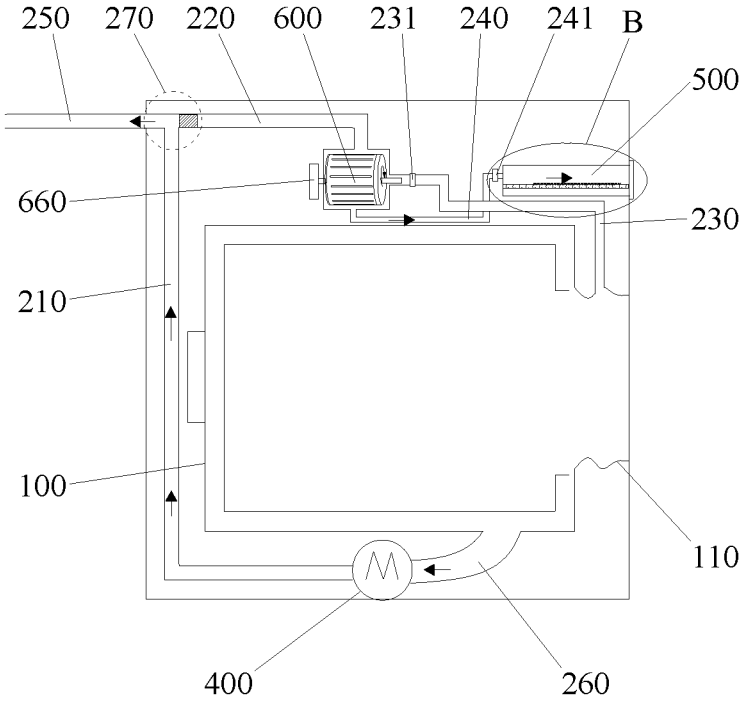
FIG. 4 is a schematic diagram of a discharge operation performed by the washing machine in embodiment one of the present disclosure.
Figure 5:
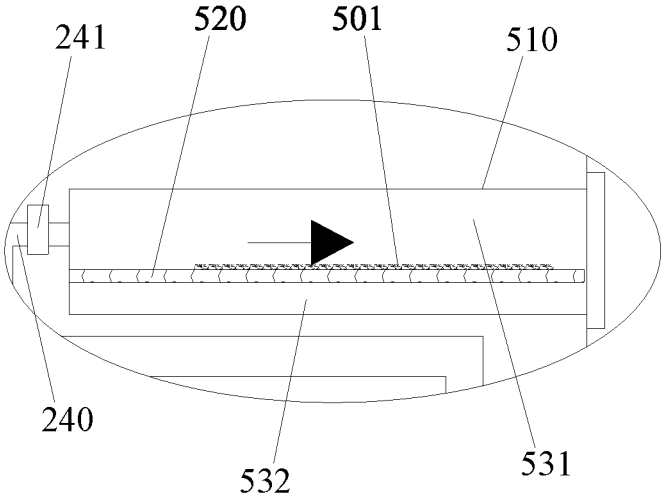
FIG. 5 is an enlarged schematic diagram of FIG. 4 at B of the present disclosure.

In the above solution, one of the filtering device 600 and the outward discharge pipeline 250 is selected to communicate with the circulation pump 400 by the arrangement of the switching device 270. As shown in FIG. 1, when the switching mechanism opens the water inlet and the first water outlet, i.e., the circulation pump 400 communicates with the filtering device 600, the washing water flows along the circulation filtering pipeline under the action of the circulation pump 400 and is filtered through the filtering device 600. As shown in FIG. 4, when the switching mechanism opens the water inlet and the second water outlet, i.e., the circulation pump 400 communicates with the outward discharge pipeline 250, the washing water in the water container 100 is pumped out through the water container drainage pipe 260 by the circulation pump 400, then passes through the drainage pipeline 210, and is finally transferred to the outward discharge pipeline 250 to be discharged from the washing machine.

In the above arrangement, there is no need to provide two mutually independent waterways inside the washing machine for circulation filtering and discharging of the washing water, respectively, in the meantime, it is not necessary to separately provide a drainage pump and a circulation pump, and only by operating the switching device 270 to change the communication mode between the pipelines, it is possible to separately perform the functions of outward drainage and circulation filtering of the washing water by the same circulation pump 400. This simplifies the pipeline connection structure inside the washing machine and saves the space occupied by the pipeline, while providing only one circulation pump 400 also reduces the production cost.

In a further solution of the present embodiment, a water return control valve 231 is arranged between the filtering device 600 and the water outlet end of the circulation filtering pipeline, i.e., the water return pipeline 230 for controlling the on-off of the water return pipeline 230, thereby controlling the on-off of the circulation filtering pipeline.

In the above solution, when the washing water in the water container 100 is circulated and filtered, the washing water passes through the water container drainage pipe 260, the drainage pipeline 210, the circulation pipeline 220 and the filtering device 600 in sequence under the action of the circulation pump 400, and is finally returned to the water container 100 through the water return pipeline 230. When the filtered impurities 501 remaining in the filtering device 600 need to be discharged, the water return control valve 231 is closed to disconnect the filtered water outlet 6102 with the water container 100, and the washing water cannot flow out from the filtered water outlet 6102. At the same time, the discharge control valve 241 is opened to open the discharge pipeline 240, which ensures that all the washing water entering the filtering device 600 flows out through the discharge outlet 6103, and the filtered impurities 501 are sufficiently carried out from the filtering device 600.

In a specific solution of the embodiment, a filtered water outlet 6102 is also arranged in the filtering cavity 610 of the filtering device 600, and both the water inlet 6101 and the filtered water outlet 6102 are connected with the circulation filtering pipeline. The filtering device 600 further includes a driving mechanism 660 for driving the filtering mechanism 620 to rotate within the filtering cavity 610.

Figure 15:
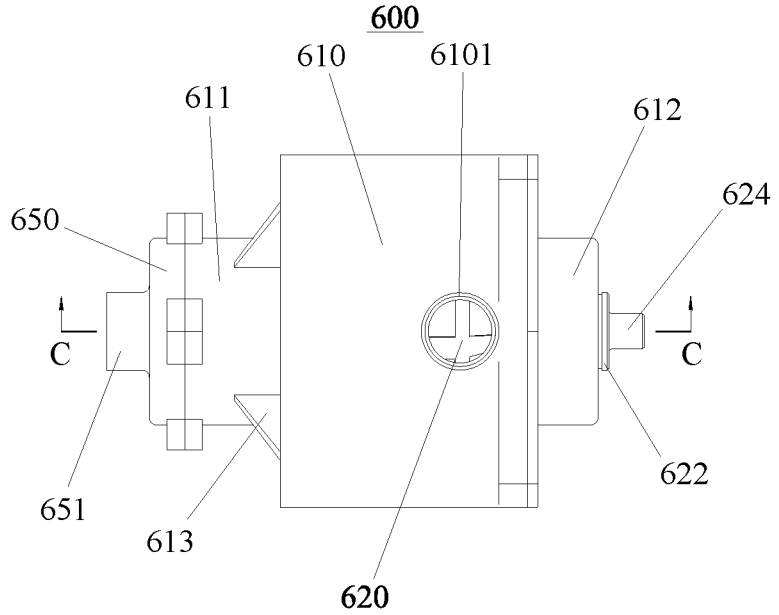
FIG. 15 is a structural schematic diagram of the filtering device in an embodiment of the present disclosure.
Figure 16:
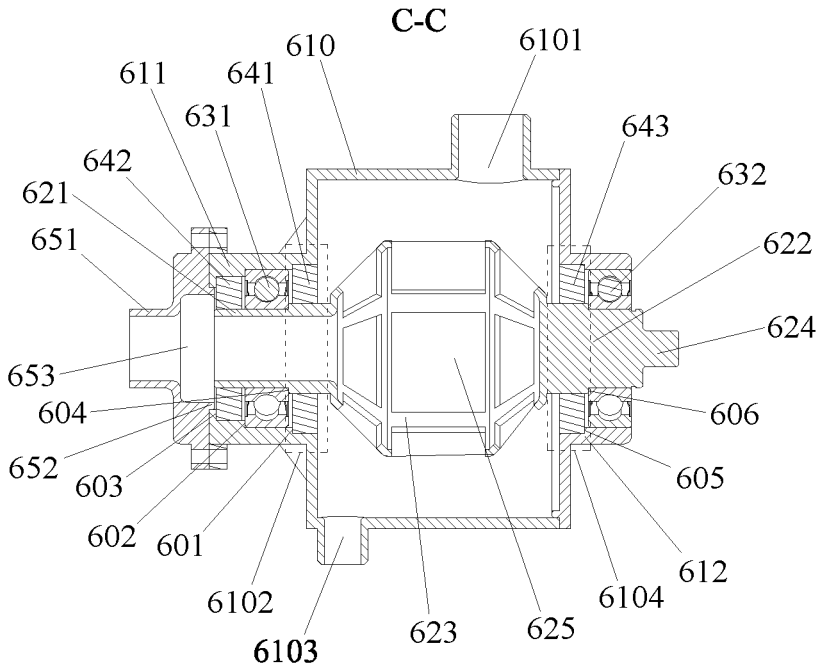
FIG. 16 is a schematic diagram of a section C-C of FIG. 15 of the present disclosure.

As shown in FIGS. 15 and 16, the filtering mechanism 620 includes a filter screen support and a filter screen 625, and the filter screen support specifically includes:

- a filter screen support 623, located inside the filtering cavity 610, the filter screen 625 covering a surface of the filter screen support 623 to divide the inside of the filtering cavity 610 into an outer cavity and an inner cavity; and
- a water outlet connector 621, communicating with the inner cavity.

When the washing water is circularly filtered, the washing water to be filtered is transferred to the filtering device 600 and enters the outer cavity inside the filtering cavity 610 from the water inlet 6101, and when the washing water passes through the filtering mechanism 620, the filtered impurities 501 in the washing water are blocked by the filter screen 625 and attached to the surface of the filter screen 625, so that the washing water entering the inner cavity no longer contains the filtered impurities 501 such as thread scraps. The filtered clean washing water passes through the water outlet connector 621 and finally flows out of the filtering cavity 610 through the filtered water outlet 6102.

When it is necessary to clean the filtering device 600, the filtering mechanism 620 is driven to rotate in the filtering cavity 610 by the driving mechanism 660, such as a motor, to agitate the water remaining in the filtering cavity 610, so that the filtered impurities 501 on the surface of the filter screen 625 are peeled off from the filter screen 625 by the centrifugal force and the agitated water flow, are mixed into the water in the filtering cavity 610, are discharged out of the filtering cavity 610 through the discharge outlet 6103, and are collected by the recovery device 500.

In a preferred solution of the embodiment, the orientation of the filtered water outlet 6102 is parallel to the axial direction of the filtering mechanism 620.

In particular, the water outlet connector 621 is arranged at the left end of the filter screen support 623 with its axis coinciding with the axis of the filtering mechanism 620, and the water outlet connector 621 is rotatably and sealingly connected with the filtered water outlet 6102.

In the embodiment, the axis of the filtering mechanism 620 is horizontally arranged, the orientation of the filtered water outlet 6102 is the horizontal direction, the water inlet 6101 is vertically arranged upward, and the discharge outlet 6103 is vertically arranged downward. The washing water to be filtered, as well as the washing water for flushing the filtering mechanism 620, enters from the top of the filtering cavity 610, and the water flow can smoothly flow out of the filtered water outlet 6102 or the discharge outlet 6103 under its own gravity. The discharge outlet 6103 is arranged at the bottom of the filtering cavity 610, and discharges the sewage carrying the filtered impurities 501 downward, and sufficient discharge of the filtered impurities 501 is facilitated since the filtered impurities 501 tend to pool at the bottom of the filtering cavity 610 after being peeled off from the filter screen 625.

The present embodiment also provides a control method of the washing machine as described above, wherein the circulation filtering operation, the self-cleaning operation, and the discharge operation are separately performed in the washing program of the washing machine.

Figure 2:
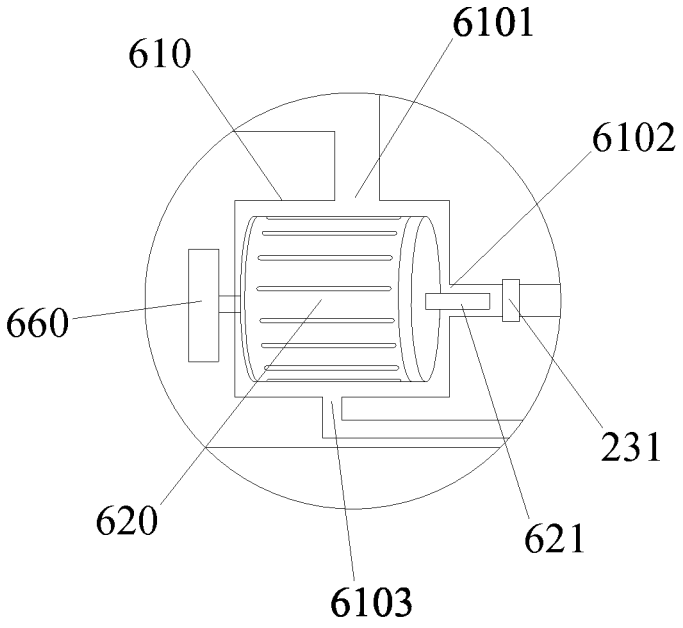
FIG. 2 is an enlarged schematic diagram of FIG. 1 at A of the present disclosure.

In particular, as shown in FIGS. 1 and 2, the circulation filtering operation includes: the discharge control valve 241 is closed, while the water return control valve 231 is opened to open the water return pipeline 230; the circulation pump 400 is turned on, and the water from the water container 100 is introduced into the circulation filtering pipeline, after the filter impurities are removed by the filtering device 600, the water is then returned to the water container 100.

Figure 3:
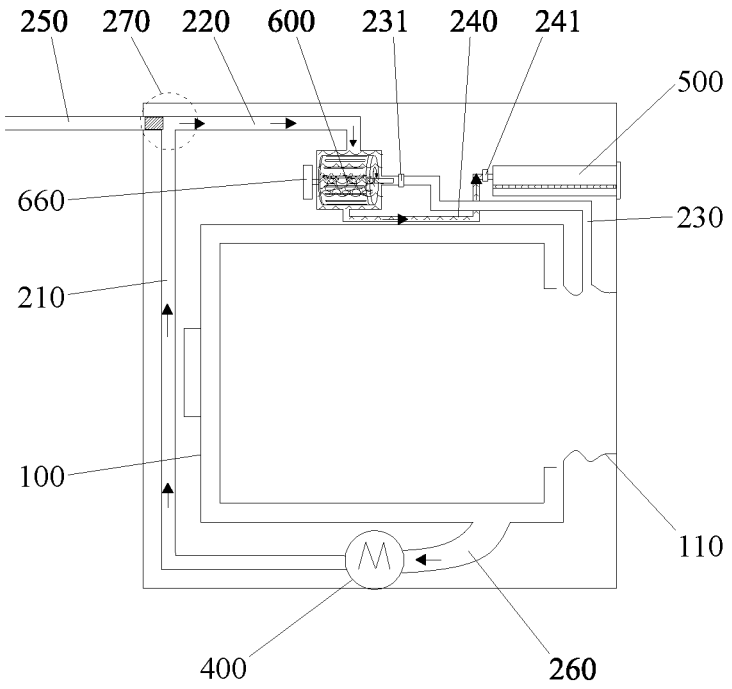
FIG. 3 is a schematic diagram of a self-cleaning operation performed by the washing machine in embodiment one of the present disclosure.

As shown in FIG. 3, the self-cleaning operation includes: the water return control valve 231 is closed, the discharge control valve 241 is opened to open the discharge pipeline 240, the circulation pump 400 is turned on, the water contained in the water container 100 is introduced into the filtering device 600 to clean the filtering device 600 and then the water is discharged into the recovery device 500. The self-cleaning operation also includes: the driving mechanism 660 is controlled to drive the filtering mechanism 620 to rotate within the filtering cavity 610.

As shown in FIG. 4, the discharge operation includes: the discharge control valve 241 is opened to open the discharge pipeline 240 to discharge the sewage carrying the filtered impurities 501 in the filtering device 600 into the recovery device 500. The driving mechanism 660 may be controlled to be opened to drive the filtering mechanism 620 to rotate while the discharge operation is being performed, or the driving mechanism 660 may not be opened and the filtering mechanism 620 remains stationary within the filtering cavity 610.

In the embodiment, the circulation filtering operation is performed in both the washing stage and the one to more rinsing stages of the washing program, and the self-cleaning operation and/or the discharge operation is performed at least once in a complete washing program. Preferably, the self-cleaning operation and the discharge operation are performed both at the washing stage and at the end of each rinsing stage.

In particular, the circulation pump 400 is turned on after the water is fed for a certain period of time in the washing stage and each rinsing stage, and the circulation filtering operation is performed. The circulation filtering operation continues until the washing or rinsing stage is near completion, i.e., when drainage is about to occur, the water return control valve 231 is closed, the discharge control valve 241 is opened and the driving mechanism 660 is turned on to perform a self-cleaning operation. After the self-cleaning operation lasts for a certain period of time, the washing machine performs the discharge operation.

In detail, after the washing machine starts to feed water, the water level in the water container 100 is detected, and when the water level reaches a preset level, the circulation pump 400 is turned on to perform the circulation filtering operation. This prevents the amount of water in the water container 100 from being too small and the air sucked inside the circulation pump 400 from generating operational noise. While the washing machine performs the discharge operation, the switching device 270 is controlled to operate to make the drainage pipeline 210 communicate with the outward discharge pipeline 250, and the circulation pump 400 is continuously operated to discharge the remaining water in the water container 100.

In the embodiment, the washing machine is provided with the filtering device 600, which circulates and filters the water in the water container 100 during the operation of the washing machine, thereby reducing the amount of thread scraps in the water, and improving the washing effect. The filtering device 600 can be self-cleaned, thereby discharging the filtered impurities 501 remaining inside the filtering device 600, without the need for a user to remove the filtering device 600 from the washing machine for manual cleaning, which is convenient to use. The recovery device 500 is arranged in the washing machine and communicates with the filtering device 600, and the filtered impurities 501 discharged by the filtering device 600 can be collected, and the filtered impurities 501 can be prevented from being mixed into the water discharge flow of the washing machine and directly discharged into the washing machine and further into the ecological cycle, so that the fine thread scraps in the filtered impurities 501 can be prevented from causing hazards to the ecological environment and human health.

Embodiment 2

Figure 6:
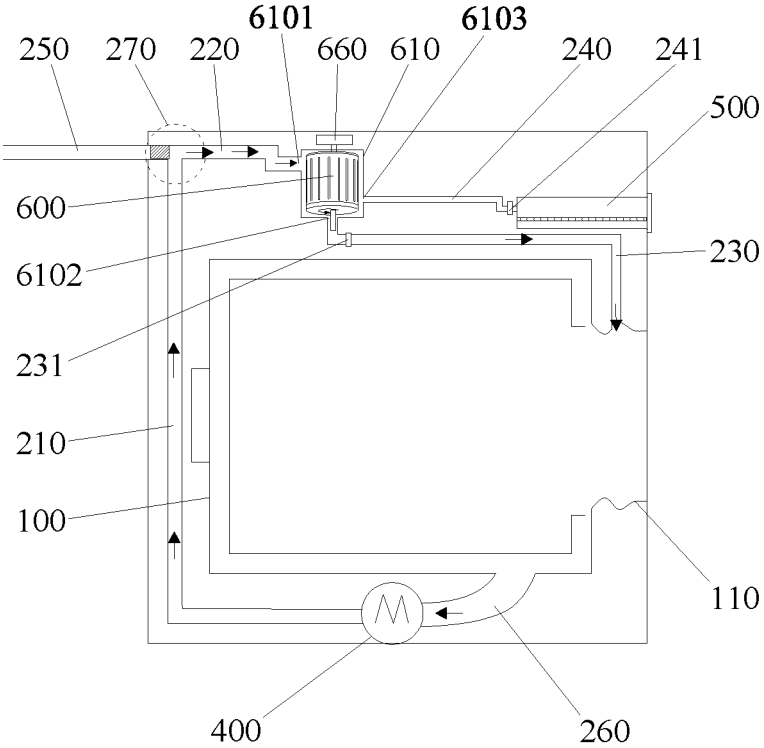
FIG. 6 is a structural schematic diagram of the washing machine in embodiment two of the present disclosure.

As shown in FIG. 6, the present embodiment differs from the above-described embodiment one in that the axis of the filtering mechanism is vertically arranged.

In particular, the filtered water outlet 6102 on the filtering cavity 610 is vertically arranged downward, and the orientations of the water inlet 6101 and the discharge outlet 6103 are opposite and are both parallel to the horizontal direction. Preferably, the water inlet 6101 is arranged higher than the discharge outlet 6103, and the filtered impurities remaining in the filtering device 600 are sufficiently discharged to prevent the filtered impurities remaining in the filtering device 600 from generating bacteria in the filtering device 600 and contaminating the washing water.

In the embodiment, other structures and control methods of the washing machine are the same as those of embodiment one, and the operation effects are similar to those of embodiment one.

Embodiment 3

As shown in FIGS. 1 and 2, the present embodiment provides a control method of the washing machine according to embodiment one for sufficiently discharging the sewage inside the filtering device 600.

In particular, the control method includes:

- the circulation pump 400 is turned on to open the circulation filtration pipeline, and the washing machine performs circulation filtering rinsing;
- rinsing is finished, the circulation pump 400 is turned off;
- the driving mechanism 660 is turned on to drive the filtering mechanism 620 to rotate in the filtering cavity 610;
- a first set condition is reached, the circulation pump 400 is turned on, and at the same time, the discharge control valve 241 is opened to open the discharge pipeline 240; and
- a second set condition is reached and the circulation filtering pipeline is cut off.

Preferably, after the first set condition is reached, the driving mechanism 660 remains in an on-state to drive the filtering mechanism 620 to rotate continuously.

In the present embodiment, the step that the circulation filtering pipeline is opened includes: the switching device 270 makes the filtering device 600 communicate with the water outlet end of the circulation pump 400, and the water return control valve 231 is opened to open the water return pipeline 230. The step that the circulation filtering pipeline is cut off includes: the switching device 270 makes the outward discharge pipeline 250 communicate with the water outlet end of the circulation pump 400.

It will be appreciated that cutting off the circulation filtering pipeline may also be accomplished by closing the circulation pump 400.

In the above solution, the washing machine circularly filters the rinsing water during the rinsing process, and the filtering device 600 and the circulation filtering pipeline are filled with the rinsing water at all times.

Figure 8:
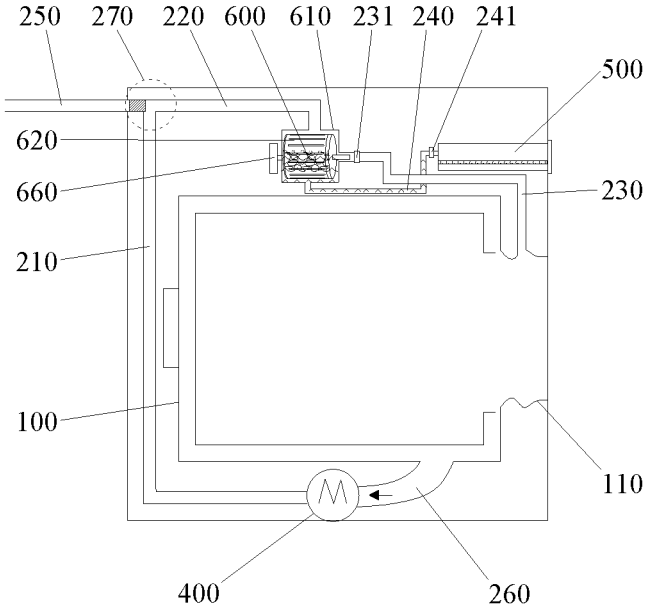
FIG. 8 is a schematic diagram of the first stage of cleaning the filtering device after the last rinsing is finished in the washing machine in embodiment three of the present disclosure.

As shown in FIG. 8, after closing the circulation pump 400 at the end of the rinsing, the water in the drainage pipeline 210 and the circulation pipeline 220 flows back downward by gravity at most until the level of the water in the drainage pipeline 210 is level with the level of the water in the water container 100, and the pipeline above the water level up to the filtering device 600 is filled with air. However, the filtering device 600 is lower than the circulation pipeline 220, and the water therein does not flow backward through the circulation pipeline 220. The water return control valve 231 is also closed while the circulation pump 400 is closed, and the discharge control valve 241 is in an off-state, and the water inside the filtering device 600 remains in the filtering cavity 610 and is not discharged outwardly.

Figure 9:
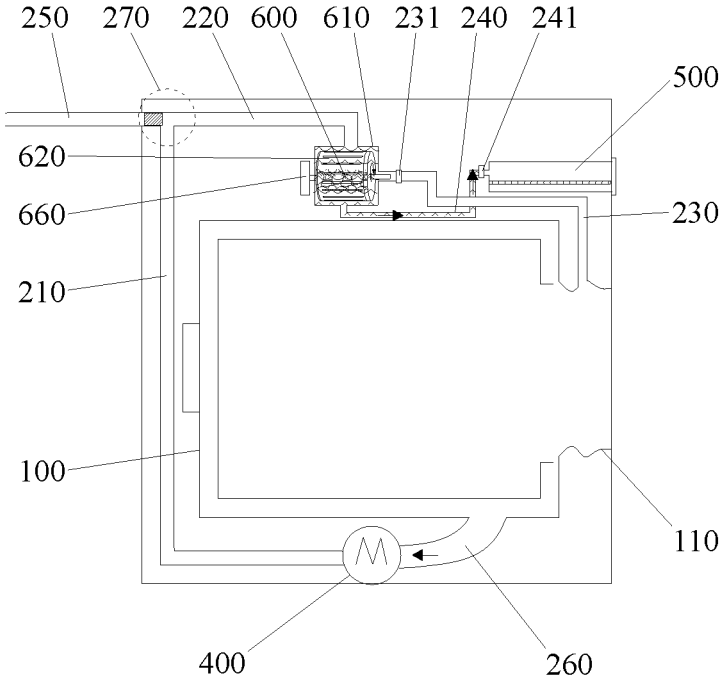
FIG. 9 is a schematic diagram of the second stage of cleaning the filtering device after the last rinsing is finished in the washing machine in embodiment three of the present disclosure.

As shown in FIG. 9, after the driving mechanism 660 is turned on, the filtering mechanism 620 is driven to rotate at a high speed, so that the filtered impurities, such as thread scraps, attached to the surface are peeled off from the surface of the filtering mechanism 620 by centrifugal force. At this time, since the water return control valve 231 and the discharge control valve 241 are in an off-state, the water in the filtering cavity 610 does not flow out, and the filtering mechanism 620 which rotates at a high speed can agitate the water flow in the filtering cavity 610, so that the resulting agitated water flow causes a certain impact force on the surface of the filtering mechanism 620, and the thread scraps can fall off. The thread scraps peeled from the surface of the filtering mechanism 620 are mixed into the water within the filtering cavity 610.

Figure 10:
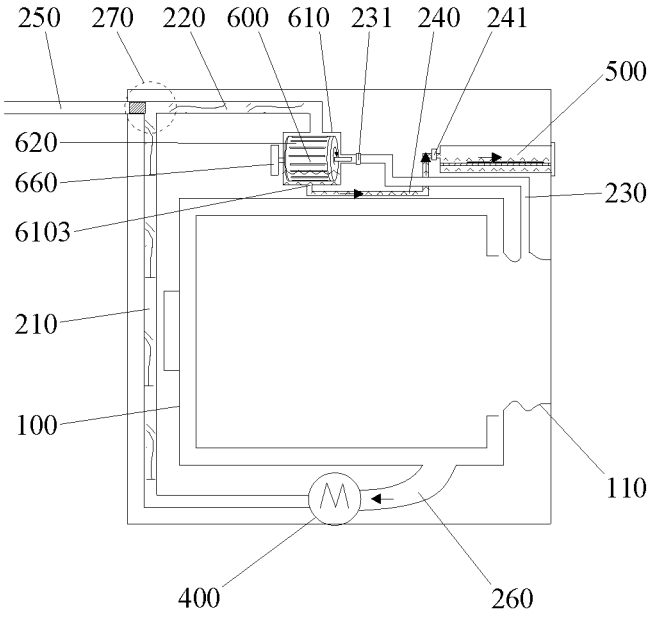
FIG. 10 is a schematic diagram of the third stage of cleaning the filtering device after the last rinsing is finished in the washing machine in embodiment three of the present disclosure.

As shown in FIG. 10, at the same time as the circulation pump 400 is turned on, the discharge control valve 241 is also opened so that the discharge pipeline 240 is opened, and the sewage in the filtering device 600 can be discharged from the discharge outlet 6103. The circulation pump 400 is turned on to press the air in the drainage pipeline 210 and the circulation pipeline 220 into the filtering device 600, thereby completely discharging the sewage carrying the thread scraps in the filtering device 600 through the discharge outlet 6103 under the air pressure, thus avoiding the presence of sewage residue in the filtering device 600, and achieving the excellent cleaning effect of the filtering device 600. The discharge control valve 241 is opened at the same time as the circulation pump 400 is turned on to ensure the pressure generated when the air is introduced into the filtering device 600, thereby ensuring that the sewage in the filtering device 600 is sufficiently discharged.

In order to prevent the water in the water container 100 from entering the filtering device 600 through the circulation pipeline 220 after the sewage in the filtering device 600 is discharged, the washing machine presets a second set condition, and when the second set condition is reached, the circulation filtering pipeline is cut off to stop the water in the water container 100 from being transported to the filtering device 600.

In a specific solution of the embodiment, the first set condition may be that after the circulation pump 400 is turned off, a first set time t1 is reached, and the second set condition may be that after the circulation pump 400 is turned on, a second set time t2 is reached.

In the above solution, the specific values of the first set time t1 and the second set time t2 can be derived in advance through a large number of experiments and directly written into the control program of the washing machine.

In particular, the first set time t1 takes the value of about the maximum length of time required for the level of the water in the drainage pipeline 210 to begin to fall until it stops, and the second set time t2 takes the value of about the minimum length of time required for the level of the water in the drainage pipeline 210 to rise to near the top end of the drainage pipeline 210 after the circulation pump 400 is turned on. In this way, it is possible to ensure that a greater amount of air can be introduced into the pipeline when the circulation pump 400 is turned off, and the situation that water enters the filtering device 600 after the circulation pump 400 is turned on can be effectively avoided.

In another solution of the embodiment, the height of the water level may also be used as the first set condition and the second set condition. In particular, the first set condition is that the water level in the pipeline between the circulation pump 400 and the filtering device 600 reaches a first set value H1. The second set condition is that the water level in the pipeline between the circulation pump 400 and the filtering device 600 reaches a second set value H2, and H1<H2.

In the present embodiment, the water level is specifically the height of the water level in the drainage pipeline 210, and a water level detection device may be arranged in the drainage pipeline 210 of the washing machine to detect the water level in the drainage pipeline 210.

In the above solution, the first set value H1 is greater than and as close as possible to the maximum water level of the washing machine to ensure that the water level in the drainage pipeline 210 can be lowered to the first set value H1 after the circulation pump 400 is turned off.

There is generally a time difference between the time when the washing machine receives a signal that the water level in the drainage pipeline 210 rises to the second set value H2 and the time when the switching device 270 makes the drainage pipeline 210 communicate with the outward discharge pipeline 250. In order to avoid water from entering the filtering device 600 after the circulation pump 400 is turned on due to response delay, a certain difference ΔH is required between the second set value H2 and the height of the water level corresponding to the top end of the drainage pipeline 210. The specific value of the difference ΔH can be obtained by a number of experiments carried out in advance, so as to ensure that the washing machine has a sufficient response time to control the switching device 270 to complete the switching of the waterways after receiving a signal that the water level reaches the second set value H2.

In a further solution of the present embodiment, when the washing machine judges that the current running course is the last rinsing stage in the present washing program, the circulation pump 400 is turned off after the rinsing is finished, and the circulation pump 400 is turned on after the first set condition is reached.

When the washing machine judges that the current running course is not the last rinsing stage in the present washing program, then the following operations are performed after rinsing is finished:

the circulation pump 400 is kept in operation;

a third set condition is reached, the circulation filtering pipeline is cut off; and in the above solution, for the intermediate rinsing stage, since the washing machine needs to continue to run, that is, the rinsing water will circularly passes through the filtering device 600 for filtering, the sewage carrying the thread scraps in the filtering device 600 cannot be discharged completely at this time, but only the thread scraps attached to the surface of the filtering mechanism 620 can be removed.

Figure 7:
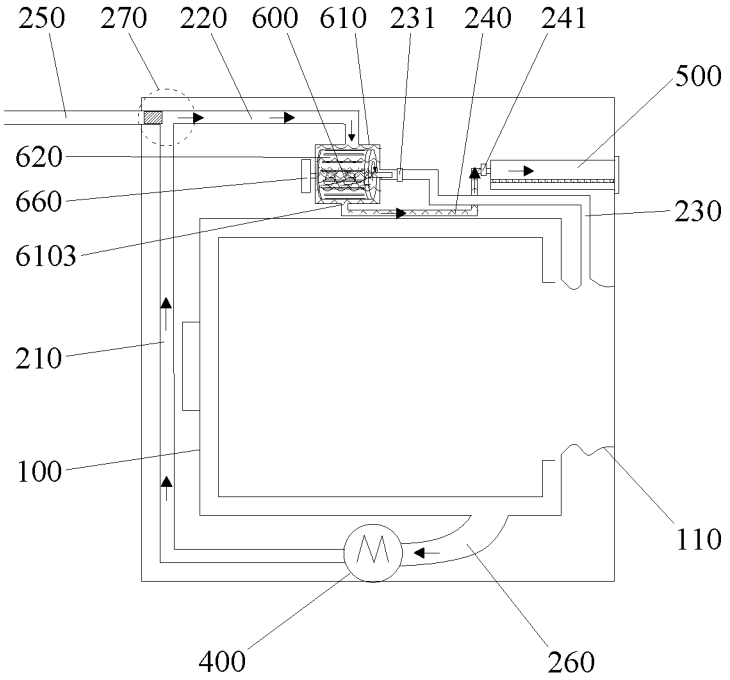
FIG. 7 is a schematic diagram of cleaning the filtering device after the intermediate rinsing is finished in the washing machine in embodiment three of the present disclosure.

As shown in FIG. 7, after the rinsing is finished, the water return control valve 231 is closed, the discharge control valve 241 is opened, the circulation pump 400 is kept in operation, and the water in the water container 100 is continuously transferred to the filtering device 600 by the circulation pump 400 to flash the inside of the filtering device 600, and the flashed sewage is discharged into the discharge pipeline 240 through the discharge outlet 6103.

In the embodiment, the third set condition may be that after the rinsing is finished, a third preset time t3 is reached, the value of which has been obtained experimentally in advance and written into the control program to ensure that the thread scraps attached to the surface of the filtering device 620 can be substantially removed.

Or, the circulation filtering pipeline may be cut off when the water level in the water container 100 falls to a preset value ΔH1. That is, the switching device 270 is controlled to make the drainage pipeline 210 communicate with the outward discharge pipeline 250, and the circulation pump 400 continues to operate to drain the remaining water in the water container 100 out of the washing machine.

In a preferred solution of the embodiment, after the rinsing is finished, the driving mechanism 660 is turned on and the filtering mechanism 620 is driven to rotate at a high speed within the filtering cavity 610, so that the water within the filtering cavity 610 is agitated and the attached thread scraps are peeled off from the surface of the filtering mechanism 620 by the dual action of centrifugal force and the agitated water flow, are mixed into the water within the filtering cavity 610, and are removed from the filtering cavity 610 through the discharge outlet 6103, thus achieving high cleaning efficiency of the thread scraps.

In the embodiment, the washing machine performs the operation of turning off the circulation pump 400 first and then turning on the circulation pump 400 only after the last rinsing is finished, so as to completely discharge the sewage in the filtering device 600. When the intermediate rinsing is finished, the circulation pump 400 is kept in operation, it is avoided that the circulation pump 400 is frequently turned on and off during the operation of the washing machine to affect its service life.

In the embodiment, the washing machine also cleans the filtering device 600 after washing is finished, and the control method is specifically as follows:

the circulation pump 400 is turned on, the switching device 270 makes the water outlet end of the circulation pump 400 communicate with the filtering device 600, the water return control valve 231 is opened, and the washing machine performs circulation filtering washing;

washing is finished, the circulation pump 400 is kept in operation, the water return control valve 231 is closed, the discharge control valve 241 is opened; and a fourth set condition is reached and the switching device 270 makes the water outlet end of the circulation pump 400 communicate with the outward discharge pipeline 250.

The fourth set condition may be that after the washing is finished, a fourth preset time t4 is reached, or the water level drop height in the water container 100 reaches the preset value ΔH2.

Since the circulation filtering rinsing is further performed during the subsequent processes of the washing program after the washing is finished, it is not necessary to completely discharge the sewage from the filtering device 600 similarly to the intermediate rinsing, and the circulation pump 400 can be kept in operation without being turned off.

In the present embodiment, after the washing and intermediate rinsing are completed, the circulation pump 400 is kept in operation, and the water contained in the water container 100 is transferred to the filtering device 600 for flushing, and the flushed sewage is discharged from the discharge outlet 6103 of the filtering device 600. After the last rinsing is finished, the circulation pump 400 is turned off to wait for air to enter in the pipeline, and then the circulation pump 400 is turned on again, and the air in the pipeline is forced into the filtering device 600, thereby completely discharging the sewage therein, and ensuring that no sewage remains in the filtering device 600 after the washing machine stops operating, which can effectively avoid bacterial growth. In the meantime, the washing machine performs the operation of turning off the circulation pump 400 and turning on again only after the last rinsing is finished, thus reducing the unnecessary on-off operation of the circulation pump 400, and extending the service life of the circulation pump 400.

Embodiment 4

As shown in FIGS. 11 to 14, the washing machine according to the present embodiment includes:

- a water container 100, a water container water outlet 102 being arranged thereon;
- a drainage waterway 280, a water inlet end of which being connected with the water container water outlet 102 and configured to discharge water to the outside of the washing machine;
- a filtering device 600, communicating with the water container 100 to receive the water in the water container 100 for filtering, and provided with a discharge outlet 6103 for discharging filtered impurities;
- a discharge pipeline 240, a water inlet end of which being connected with the discharge outlet 6103, and a water outlet end of which being connected with the drainage waterway 280; and
- a discharge control valve 241, arranged on the discharge pipeline 241 and configured to controlling the on-off of the discharge pipeline 240.

In the embodiment, the filtering device 600 filters the water contained in the water container 100, and the filtered impurities are discharged through the discharge outlet 6103. When the discharge control valve 241 is opened, the sewage carrying the filtered impurities is discharged into the drainage waterway 280 along the discharge pipeline 240, and further is discharged out of the washing machine along the drainage waterway 280. In the above manner, the washing machine can achieve automatic cleaning and discharging of the filtered impurities in the filtering device 600, eliminating the trouble of a user manually cleaning the filtering device 600.

In particular, the water contained in the water container 100 can be introduced into the filtering device 600 to flush the inside of the filtering device 600, so that the filtered impurities attached to the filtering device 600 fall off, and mixed into the washing water, and discharged from the discharge outlet 6103 together with the washing water.

The water inlet end of the drainage waterway 280 is directly connected with the water container water outlet 102 of the water container 100, and the water in the water container 100 can be discharged directly along the drainage waterway 280 without passing through the filtering device 600. In the case where there is no need to clean the filtering device 600, the water in the water container 100 enters the drainage waterway 280 through the water container water outlet 102, and is directly discharged from the washing machine, and the drainage efficiency is higher.

In a further solution of the embodiment, the discharge pipeline 240 is unidirectionally opened from the discharge outlet 6103 to the drainage waterway 280 when the discharge control valve 241 is opened.

In the above solution, the discharge control valve 241 is set to be unidirectionally opened to prevent backflow of the sewage in the discharge pipeline 240 and backflow into the filtering device 600, and also to prevent the drainage water flow in the drainage waterway 280 from flowing along the discharge pipeline 240 to the filtering device 600.

In particular, the discharge pipeline 240 includes a sewage discharge section 242 extending vertically upward for a certain length, an upper end of the sewage discharge section 242 being connected with the drainage waterway 280. A discharge control valve 241 is arranged on the sewage discharge section 242.

The sewage discharged by the filtering device 600 flows along the discharge pipeline 240 and eventually flows upward in the sewage discharge section 242 into the drainage waterway 280. The water in the sewage discharge section 242 easily flows back by gravity, and the discharge control valve 241 is arranged on the sewage discharge section 242, so that the effect of preventing backflow is better.

In the preferred solution of the embodiment, the discharge control valve 241 is arranged near the upper end of the sewage discharge section 242. Since the upper end of the sewage discharge section 242 is connected with the drainage waterway 280, the discharge control valve 241 is close to the upper end of the sewage discharge section 242, i.e., close to the water outlet end of the discharge pipeline 240, and the drainage water flow in the drainage waterway 280 can be more effectively prevented from flowing into the discharge pipeline 240 through the connection between the discharge pipeline 240 and the drainage waterway 280.

Further, the drainage waterway 280 includes an upper drainage pipe 284 extending vertically for a certain length, in which the drainage water flow flows upwardly. The upper end of the sewage discharge section 242 is connected with the lower end of the upper drainage pipe 284.

In the above solution, the sewage in the discharge pipeline 240 flows upward along the sewage discharge section 242 into the upper drainage pipe 284 of the drainage waterway 280, and continues to flow upward in the upper drainage pipe 284, i.e., the water flow does not change flowing direction after flowing into the drainage waterway 280 from the discharge pipeline 240, thereby reducing the resistance of the water flow into the drainage waterway 280. At the same time, the water flow in the upper drainage pipe 284 tends to flow downward by gravity, and in conjunction with the arrangement of the unidirectionally opened discharge control valve 241, the water flow in the upper drainage pipe 284 is effectively prevented from entering the discharge pipeline 240 from its lower end.

In a further solution of the embodiment, the circulation pump 400 is arranged on the drainage waterway 280 between the water container water outlet 102 and the water outlet end of the discharge pipeline 240, and the switching device 270 is arranged between the water outlet end of the circulation pump 400 and the water outlet end of the discharge pipeline 240.

The switching device 270 is connected with the filtering device 600 to control one of the water inlet 6101 of the filtering device 600 and the water outlet end of the drainage waterway 280 to communicate with the water outlet end of the circulation pump 400.

In detail, the drainage waterway 280 specifically includes:

- a water container discharge pipe 281, configured to connect the water container water outlet 102 with the water inlet end of the circulation pump 400;
- a circulation pipe 282, configured to connect the water outlet end of the circulation pump 400 with the switching device 270;
- a connecting pipe 283, one end of which being connected with the switching device 270, horizontally extending to a rear side of the bottom of the water container 100;

an upper drainage pipe 284, a lower end of which being connected with the connecting pipe 283, extending vertically upward to a top region of the washing machine; and an outward discharge pipe 285, connected with an upper end of the upper drainage pipe 284, extending to the outside of the washing machine for discharging water.

The switching device 270 specifically includes:

a water inlet, connected with a water outlet end of the circulation pipe 282;

a first water outlet, connected with a water inlet end of the connecting pipe 283;

a second water outlet, connected with the water inlet 6101 of the filtering device 600; and a switching mechanism, configured to control one of the first water outlet and the second water outlet to communicate with the water inlet.

Figure 12:
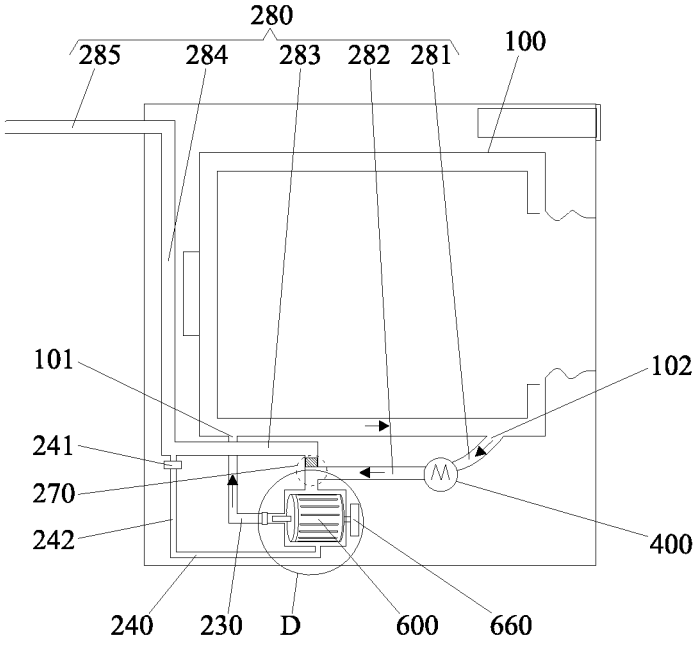
FIG. 12 is a schematic diagram of circulation filtering performed by the washing machine in embodiment four of the present disclosure.
Figure 13:
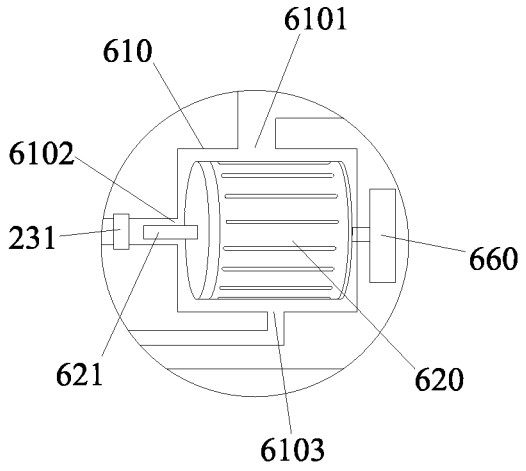
FIG. 13 is an enlarged schematic diagram of FIG. 12 at D of the present disclosure.
Figure 14:
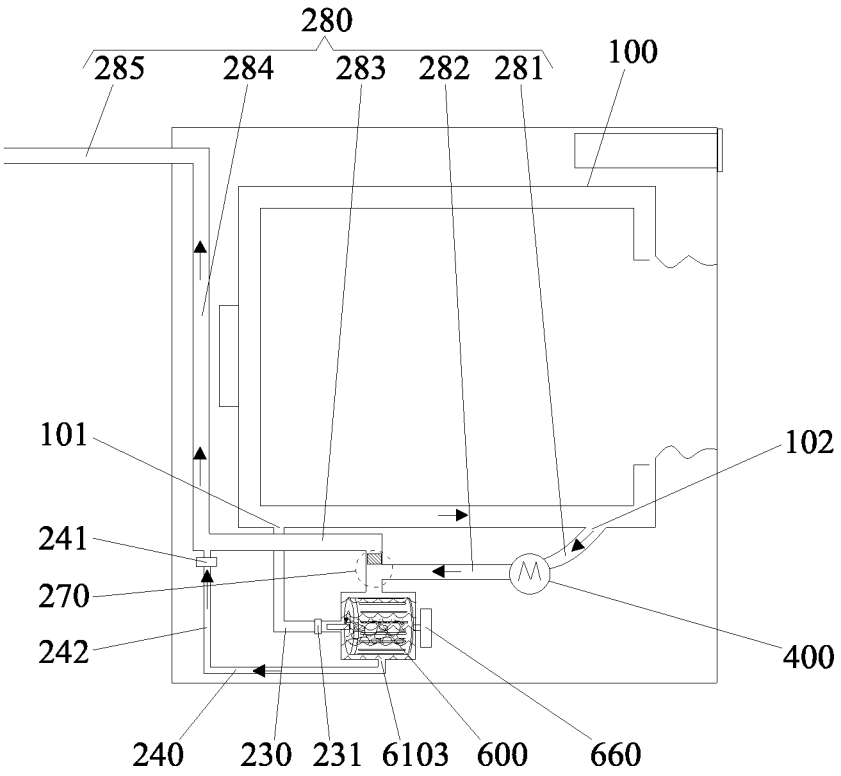
FIG. 14 is a schematic diagram of cleaning the filtering device in the washing machine in embodiment four of the present disclosure.

As shown in FIGS. 12-14, at this time, the water inlet of the switching device 270 communicates with the first water outlet, i.e., the circulation pipe 282 communicates with the filtering device 600. After the circulation pump 400 is turned on, the water in the water container 100 flows through the water container discharge pipe 281, the circulation pump 400 and the circulation pipe 282 sequentially into the filtering device 600.

Figure 11:
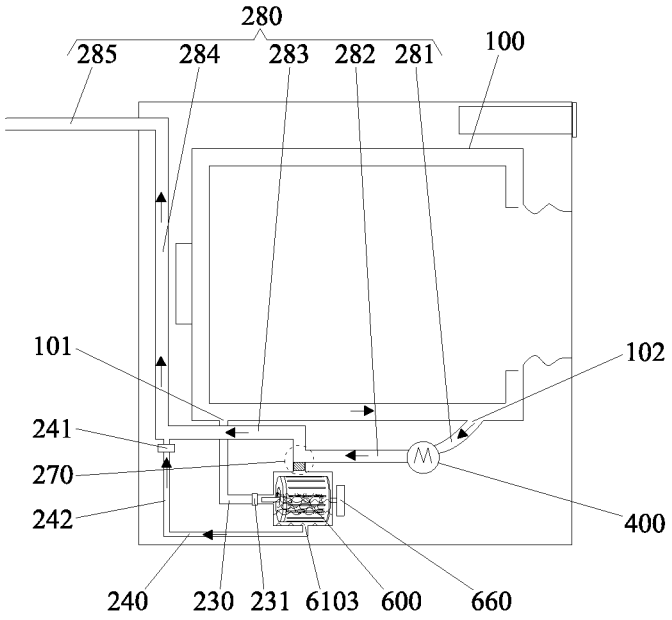
FIG. 11 is a structural schematic diagram of the washing machine in embodiment four of the present disclosure.

As shown in FIG. 11, at this time, the water inlet of the switching device 270 communicates with the second water outlet, that is, the circulation pipe 282 communicates with the connecting pipe 283. After the circulation pump 400 is turned on, the water in the water container 100 flows through the water container discharge pipe 281, the circulation pump 400, the circulation pipe 282, the connecting pipe 283 and the upper discharge pipe 284 in sequence, and is finally discharged from the washing machine through the outer discharge pipe 285.

In a further solution of the embodiment, the water container 100 is provided with a water container water return port 101 at the bottom region thereof, and the filtering device 600 is provided with a filtered water outlet 6102 for discharging the filtered water. The filtered water outlet 6102 communicates with the water container water return port 101 through a water return pipeline 230, and a water return control valve 231 is arranged on the water return pipeline 230 for controlling on-off of the water return pipeline 230.

When the switching device 270 makes the circulation pipe 282 communicate with the filtering device 600, as shown in FIGS. 2 and 3, the water return control valve 231 is opened to open the water return pipeline 230, the circulation pump 400 is turned on, and the water in the water container 100 is introduced into the filtering device 600 along the water container discharge pipe 281 and the circulation pipe 282. The filtering device 600 filters the incoming water, and the filtered water flows out from the filtered water outlet 6102 and is returned to the water container 100 along the water return pipeline 230. During washing and rinsing, the water in the water container 100 is continuously circulated to pass through the filtering device 600 by the circulation pump 400, thereby reducing the amount of thread scraps in the water and improving the washing effect.

As shown in FIG. 14, the water return control valve 231 is closed, the discharge control valve 241 is opened to open the discharge pipeline 240, and the circulation pump 400 is operated to introduce water from the water container 100 to the filtering device 600. Since the water return pipeline 230 is cut off, the introduced water flushes the inside of the filtering device 600, and is discharged from the discharge outlet 6103 together with the flushed filtered impurities such as thread scraps, enters the upper drainage pipe 284 of the drainage waterway 280 along the discharge pipeline 240, and is discharged from the washing machine along the upper drainage pipe 284 and the outward discharge pipe 285.

In the embodiment, the filtering device 600 specifically includes: a filtering cavity 610, a water inlet 6101, a filtered water outlet 6102 and a discharge outlet 6103 being arranged thereon; a filtering mechanism 620, rotatably arranged within the filtering cavity 610 and dividing the inside of the filtering cavity 610 into an outer cavity and an inner cavity; and a driving mechanism 660, configured to drive the filtering mechanism 620 to rotate within the filtering cavity 610.

The water introduced into the filtering device 600 is introduced into the outer cavity through the water inlet 6101 and is filtered through the filtering mechanism 620, the filtered impurities such as the thread scraps are attached to the outer surface of the filtering mechanism 620, and the filtered water is introduced into the inner cavity through the filtering mechanism 620. The filtering mechanism 620 has a water outlet connector 621 communicating with the filtered water outlet 6102, through which the filtered water in the inner cavity is discharged from the filtered water outlet 6102. The driving mechanism 660 can drive the filtering mechanism 620 to rotate at a high speed within the filtering cavity 610 so that the filtered impurities are released from the surface of the filtering mechanism 620 and discharged through the discharge outlet 6103.

In the embodiment, when the filtering device 600 is installed in the washing machine, the filtering mechanism 620 has its axis disposed horizontally, i.e., the filtered water outlet 6102 is oriented horizontally, the water inlet 6101 is oriented upward to receive water from the water container 100, and the discharge outlet 6103 is oriented downward, and the filtered impurities such as thread scraps can be discharged from the discharge outlet 6103 by gravity.

In another solution of the embodiment, the filtering mechanism may be installed in a washing machine with the axis being horizontal or vertical. In this case, both the orientations of the water inlet and the discharge outlet are the horizontal direction, and preferably, the height of the discharge outlet is lower than that of the water inlet. Correspondingly, the filtered water outlet is arranged downward for discharging filtered water out of the filtering device.

In a further solution of the embodiment, both the water container water outlet 102 and water container water return port 101 are arranged on the container wall of the water container 100 at the bottom region of the water container 100.

In a preferred solution of the embodiment, the water container water outlet 102 is arranged adjacent the container mouth of the water container 100 and the water container water return port 101 is arranged adjacent the container bottom of the water container 100.

During the circulation filtering process, water in the bottom region of the water container 100 tends to flow from the water container water return port 101 to the water container water outlet 102 inside the water container 100. The water container water outlet 102 is arranged in a bottom region of the container wall of the water container 100 near the container mouth, the water container water return port 101 is arranged in the bottom region of the container wall of the water container 100 near the container bottom so that the distance therebetween is maximized to form a water flow flows from the container bottom to the container mouth. The water flow flows at the bottom of the water container 100 for a longer distance and covers a wider range.

When the washing machine starts to circulate the water in the water container 100 during the water inlet process, especially during the washing water inlet process, the water flow flows in a large range at the bottom of the water container 100, which is beneficial to promoting the dissolution of washing reagents and helping to quickly wet clothes.

In another preferred solution of the embodiment, the water container water outlet can be arranged near the container bottom of the water container, and the water container water return port can be arranged near the container mouth of the water container. Similar to the previous solution, the water flow from the container mouth to the container bottom can be formed at this time, and the water flow range can almost cover the whole radial length range of the water container, which can strengthen the water flow in a wider range and improve the washing effect.

In the present embodiment, the washing machine specifically performs the circulation filtering operation, the self-cleaning operation, and the discharge operation, respectively, during the process of running the washing program.

Wherein, as shown in FIG. 12, the circulation filtering operation includes: the discharge control valve 241 is closed and the water return control valve 231 is opened to open the water return pipeline 230; the circulation pump 400 is turned on, and the water contained in the water container 100 is introduced into the filtering device 600, and after the filtering device 600 removes the filter impurities, the water is returned to the water container 100.

As shown in FIG. 14, the self-cleaning operation includes: the water return control valve 231 is closed, the discharge control valve 241 is opened to open the discharge pipeline 240, the circulation pump 400 is opened, and the water contained in the water container 100 is introduced into the filtering device 600 and discharged into the drainage waterway 280 and then discharged out of the washing machine along with the filtered impurities. The self-cleaning operation also includes: the driving mechanism 660 is controlled to drive the filtering mechanism 620 to rotate at a high speed in the filtering cavity 610.

During rotation of the filtering mechanism 620, the water within the filtering cavity 610 may be agitated, thereby creating an agitated water flow that creates an impact force on the surface of the filtering mechanism 620. In this manner, the thread scraps or the like attached to the surface of the filtering mechanism 620 are peeled from the surface of the filtering mechanism 620 by the dual action of the centrifugal force and the impact force of the agitated water flow, are mixed into the water flow, and are discharged from the discharge outlet 6103, so that the thread scraps can be cleaned more thoroughly.

As shown in FIG. 11, the discharge operation includes: the water return control valve 231 is closed and the discharge control valve 241 is opened to open the discharge pipeline 240 to discharge the sewage carrying the filtered impurities in the filtering device 600 into the drainage waterway 280. The driving device 660 may be turned on to drive the filtering mechanism 620 to rotate while the discharge operation is performed, or the driving device 660 may not be turned off to leave the filtering mechanism 620 stationary within the filtering cavity 610.

Preferably, when the discharge operation is performed, the driving device 660 is turned on to drive the filtering mechanism 620 to rotate within the filtering cavity 610, thus helping to facilitate the outflow of the sewage within the filtering cavity 610 from the discharge outlet 6103.

In the embodiment, the discharge operation is performed at least once in a complete washing program.

For example, the washing machine performs the discharge operation at the drainage state of the final dewatering process, it can ensure that the sewage inside the filtering device 600 is completely discharged after the washing machine finishes running, and it is avoided that the sewage remains inside the filtering device 600 after the washing machine stops running, resulting in a humid environment inside the filtering device 600, which is liable to cause bacterial growth.

The washing machine may also perform the discharge operation at the drainage state of each dewatering process, thereby discharging all the thread scraps and sewage in the filtering device 600 at the end of each dewatering operation. When the washing machine executes the circulation filtering operation in the subsequent rinsing process, the filtering device 600 has discharged the internal thread scraps and sewage during the previous dewatering operation, which can ensure the filtering efficiency of the thread scraps.

In the embodiment, the circulation filtering operation is performed in both the washing stage and the one to more rinsing stages of the washing program. In particular, the circulation pump 400 is turned on after water feeding is performed for a certain period of time in the washing stage and each rinsing stage and the circulation filtering operation is started. The circulation filtering operation is continuously performed until washing or rinsing is finished, and then the water return control valve 231 is closed, the discharge control valve 241 is opened and the driving mechanism 660 is turned on to perform a self-cleaning operation.

In detail, after the washing machine starts to feed water, the water level in the water container 100 is detected, and when the water level reaches a preset level, the circulation pump 400 is turned on to perform the circulation filtering operation. This prevents the amount of water in the water container 100 from being too small and the air sucked inside the circulation pump 400 from generating operational noise. While the washing machine performs the discharge operation, the switching device 270 makes the circulation pipe 282 communicate with the connecting pipe 283 to open the drainage waterway 280, and the circulation pump 400 continuously operates to discharge the water in the water container 100 along the drainage waterway 280.

In the embodiment, the washing machine is provided with a filtering device 600, which circulates and filters the water in the water container 100 during the operation of the washing machine, thereby reducing the amount of thread scraps in the water, and improving the washing effect. The filtering device 600 can be self-cleaned, thereby discharging the filtered impurities remaining inside the filtering device 600, without the need for a user to remove the filtering device 600 from the washing machine for manual cleaning, which is convenient to use. The discharge outlet 6103 of the filtering device 600 communicates with the drainage waterway 280 through the discharge pipeline 240, and the sewage carrying the filtered impurities discharged from the filtering device 600 can be introduced into the drainage water flow of the washing machine and directly discharged. The drainage waterway 280 is directly connected with the water container 100, and the water discharged from the water container 100 is discharged from the washing machine along the drainage waterway 280 without passing through the filtering device 600, and the discharged water flow flows smoothly, and the water discharge efficiency is high.

Embodiment 5

As shown in FIGS. 15 and 16, the present embodiment provides a filtering device 600 applied to any one of the above embodiments one to four.

In particular, the filtering device 600 includes:

- a filtering cavity 610, provided with a water inlet 6101 and a filtered water outlet 6102, the outer periphery of the filtered water outlet 6102 extending to the outside of the filtering cavity 610 to form a sealing support 611;
- a filtering mechanism 620, rotatably arranged inside the filtering cavity 610 and provided with a water outlet connector 621 inserted into the sealing support 611 at one end, the water outlet connector 621 being rotatably and sealingly connected with the sealing support 611;
- a first bearing 631, sleeving the water outlet connector 621; and
- a first sealing member 641, arranged on a side of the first bearing 631 facing the inside of the filtering cavity 610 to block a gap between the water outlet connector 621 and the sealing support 611.

In detail, the filtering mechanism 620 includes a filter screen support and a filter screen 625, wherein the filter screen support includes:

- a filter screen support 623, located inside the filtering cavity 610, and the filter screen 625 covering the surface of the filter screen support 623;
- a water outlet connector 621, arranged at a left end of the filter screen support 623 and rotatably inserted in the sealing support 611; and
- a rotation support 622, arranged at the right end of the filter screen support 623, and rotatably connected with the filtering cavity 610.

In the above solution, the first bearing 631 is arranged between the water outlet connector 621 and the sealing support 611 to support the water outlet connector 621 so that the water outlet connector 621 rotates smoothly within the sealing support 611, and the structure is stable, thereby ensuring stable rotation of the filtering mechanism 620 within the filtering cavity 610. By providing the first sealing member 641 on the right side of the first bearing 631, the washing water in the filtering cavity 610 cannot enter the gap between water outlet connector 621 and the sealing support 611, the first bearing 631 is prevented from coming into contact with water, the first bearing 631 is prevented from failing, and the functioning effect of the first bearing 631 is ensured. At the same time, the first sealing member 641 also prevents the unfiltered washing water from flowing out of the filtered water outlet 6102 through the sealing support 611 to affect the removal efficiency of the thread scraps by the filtering device 600.

In the specific solution of the embodiment, the first sealing member 641 sleeves the water outlet connector 621, an inner wall of the first sealing member 641 is sealingly connected with an outer wall of the water outlet connector 621, and an outer wall of the first sealing member 641 is rotatably and sealingly connected with an inner wall of the sealing support 611.

In a further solution of the embodiment, the filtering device 600 further includes a second sealing member 642 arranged on a side of the first bearing 631 facing away from the inside of the filtering cavity 610 to block a gap between the water outlet connector 621 and the sealing support 611.

In particular, the second sealing member 642 sleeves the water outlet connector 621, an inner wall of the second sealing member 642 is sealingly connected with an outer wall of the water outlet connector 621, and an outer wall of the second sealing member 642 is rotatably and sealingly connected with an inner wall of the sealing support 611.

In the above solution, the second sealing member 642 is further arranged on the left side of the first bearing 631, and the water flowing out through the water outlet connector 621 can be blocked from contacting the first bearing 631 by the second sealing member 642. The first bearing 631 is arranged between the first sealing member 641 and the second sealing member 642, so that the installation environment of the first bearing 631 is guaranteed to be anhydrous to the greatest extent, thus preventing the first bearing 631 from rusting in water and affecting the smoothness of rotation of the filtering mechanism 620.

In a further solution of the present embodiment, an inner wall of the sealing support 611 has a stepped structure, and a first limiting surface 601, a second limiting surface 602, and a third limiting surface 603 having an annular structure and a gradually reduced inner diameter are formed from one end of the sealing support 611 toward the outside of the filtering cavity 610.

The surface of the first sealing member 641 facing the outside of the filtering cavity 610 abuts against the first limiting surface 601, the surface of the first bearing 631 facing the outside of the filtering cavity 610 abuts against the second limiting surface 602, and the surface of the second sealing member 642 facing the outside of the filtering cavity 610 abuts against the third limiting surface 603.

In the above solution, a plurality of vertical annular limiting surfaces are formed by the inner wall of the sealing support 611 of the stepped structure, and abut against the left side surfaces of the first sealing member 641, the first bearing 631 and the second sealing member 642, respectively to limit the movement of the three in the axial direction of the water outlet connector 621, thus preventing loosening of the mating structure between the water outlet connector 621 and the sealing support 611 during rotation of the filtering mechanism 620.

In a preferred embodiment, the outer diameter of one end of the water outlet connector 621 adjacent to the outside of the filtering cavity 610 is smaller than the outer diameter of the other end, a fourth limiting surface 604 having an annular structure and perpendicular to the axis of the water outlet connector 621 is formed on the outer wall of the water outlet connector 621. The surface of the first bearing 631 facing the inside of the filtering cavity 610 abuts against the fourth limiting surface 604.

By providing that the outer diameter of the left end of the water outlet connector 621 is smaller than the outer diameter of the right end of the water outlet connector 621, the fourth limiting surface 604 toward the left side is formed at the abrupt change in outer diameter to abut against the right side surface of the first bearing 631. In this manner, the first bearing 631 has a limiting structure on both sides, and the structure is more stable.

In the embodiment, the end of the sealing support 611 facing away from the filtering cavity 610, i.e., the left end of the sealing support 611, is connected with the filtering cavity flange 650, and the central portion of the filtering cavity flange 650 has a through opening 653 communicating with the water outlet connector 621. The outer periphery of the through opening 653 extends away from the sealing support 611 to form a connecting portion 651.

Preferably, the surface of the filtering cavity flange 650 facing one side of the sealing support 611 is provided with a raised inserting portion 652 which is inserted into an opening at the left end of the sealing support 611.

In the above solution, the left end of the sealing support 611 is connected with the filtering cavity flange 650, and a connecting portion 651 is formed on the filtering cavity flange 650, the outer diameter of the connecting portion 651 is smaller than the outer diameter of the sealing support 611, and the inner diameter of the connecting portion 651 is preferably equal to the inner diameter of water outlet connector 621. When the filtering device 600 is installed in the washing machine, the filtering device 600 is connected with the pipeline through the connecting portion 651 on the flange 650 of the filtering cavity, so as to lead out the washing water without thread scraps after filtering, compared with the way that the pipeline is directly connected to the left end of the sealing support 611, the installation is easier.

The right side of the filtering cavity flange 650 is provided with an inserting portion 652 inserted into the opening of the left end of the sealing support 611 to facilitate positioning of the filtering cavity flange 650 and the sealing support 611 when assembled. The outer periphery of each of the filtering cavity flange 650 and the sealing support 611 is provided with a plurality of fixing portions, and the filtering cavity flange 650 and the sealing support 611 are fixed by screws passing through the fixing portions.

In a further solution of the embodiment, the rotation support 622 at the right end of the filtering mechanism 620 extends along its rotation axis to the outside of the filtering cavity 610, and the filtering cavity 610 is provided with a mounting port 6104 through which the rotation support 622 passes. The rotation support 622 is rotatably and sealingly connected to the mounting port 6104.

In the embodiment, since the filtering mechanism 620 is rotated by the driving mechanism, the driving mechanism is arranged outside the filtering cavity 610 so as to avoid contact with the washing water. To this end, the rotation support 622 extends from the right end of the filtering cavity 610, and a motor mounting portion 624 is arranged at the right end of the rotation support 622 for being connected with a driving mechanism, such as a motor.

Further, the outer periphery of the mounting port 6104 extends to the outside of the filtering cavity 610 along the axis of the rotation support 622 to form the sleeve portion 612, and the third sealing member 643 sleeves the rotation support 622. The inner wall of the third sealing member 643 is sealingly connected with the outer wall of the rotation support 622, and the outer wall of the third sealing member 643 is rotatably and sealingly connected with the inner wall of the sleeve portion 612.

A second bearing 632 is also arranged between the sleeve portion 612 and the rotation support 622, and the second bearing 632 sleeves the rotation support 622 on a side of the third sealing member 643 facing the outside of the filtering cavity 610.

In the above solution, the third sealing member 643 is provided to prevent water in the filtering cavity 610 from leaking out of the mounting port 6104, and the second bearing 632 is provided to support the rotation support 622 to ensure smooth relative rotation between the rotation support 622 and the sleeve portion 612. The second bearing 632 is arranged on the right side of the third sealing member 643 and does not contact the water in the filtering cavity 610 to avoid failure.

In a preferred solution of the embodiment, an inner diameter of one end of the sleeve portion 612 adjacent to the outside of the filtering cavity 610 is smaller than an inner diameter of the other end, and a fifth limiting surface 605 having an annular structure and perpendicular to an axis of the rotation support 622 is formed on an inner wall of the sleeve portion 612. A surface of the third sealing member 643 facing the outside of the filtering cavity 610 abuts against the fifth limiting surface 605.

An outer diameter of one end of the rotation support 622 near the outside of the filtering cavity 610 is smaller than an outer diameter of the other end, and a sixth limiting surface 606 having an annular structure and perpendicular to an axis of the rotation support 622 is formed on an outer wall of the rotation support 622. A surface of the second bearing 632 facing the inside of the filtering cavity 610 abuts against the sixth limiting surface 606.

In the above solution, the inner diameter of the right end of the sleeve portion 612 is smaller than the inner diameter of the left end thereof, and the fifth limiting surface 605 toward the left side is formed at the abrupt change in inner diameter thereof, and abuts against the right side surface of the third sealing member 643. The outer diameter of the right end of the rotation support 622 is smaller than the outer diameter of the left end thereof, and the sixth limiting surface 606 toward the right side is formed at the abrupt change in outer diameter thereof, and abuts against the left side surface of the second bearing 632. The above structure restricts the movement of the third sealing member 643 and the second bearing 632 in the axial direction of the rotation support 622, and the structure is stable.

In the embodiment, the first sealing member 641, the second sealing member 642, and the third sealing member 643 are oil seals, and the right wall of the filtering cavity 610 is separate from its peripheral side wall. The filtering mechanism 620, and the first sealing member 641, the second sealing member 642 and the first bearing 631 at the left end thereof, are integrally mounted inside the filtering cavity 610, and the third sealing member 643 and the second bearing 632 are mounted at the right end thereof, and finally the right wall of the filtering cavity 610 is snap-fitted to the peripheral side wall thereof.

In the embodiment, the filter screen support 623 has a certain cross-sectional area in the middle region, and has a tapered structure at both left and right ends, so that a partial surface of the filter screen 625 is inclined to facilitate detachment of the thread scraps.

In the embodiment, the orientations of the water inlet 6101 and the discharge outlet 6103 of the filtering cavity 610 are perpendicular to the axial direction of the filtering mechanism 620.

Preferably, the filtering cavity 610 has a cylindrical structure, the water inlet 6101 is arranged near the right end of the filtering cavity 610, the discharge outlet 6103 is arranged near the left end of the filtering cavity 610, and the water inlet 6101 and the discharge outlet 6103 are symmetrically positioned in the circumferential direction of the filtering cavity 610.

In the above solution, the water inlet 6101 is positioned as far away from the water outlet connector 621 as possible so that the area of the filter screen 625 can be fully utilized. The water inlet 6101 and the discharge outlet 6103 are positioned up and down and are staggered in the axial direction of the filtering cavity 610 to facilitate sufficient discharge of the sewage from the filtering cavity 610 after cleaning the filtering device 600.

In a further solution of the embodiment, an outer wall of the sealing support 611 is provided with reinforcing bars 613 extending in a radial direction of the sealing support 611, and the reinforcing bars 613 are connected with a surface of the filtering cavity 610 where the filtered water outlet 6102 is located.

Since the sealing support 611 extends a certain length from the left end surface of the filtering cavity 610, the strength of the sealing support 611 is ensured by providing the reinforcing bars 613 to support the peripheral side wall thereof from the outside.

In the present embodiment, the filtering device 600 is provided with a rotatable filtering mechanism 620 in the filtering cavity 610, and after the washing water to be filtered enters the filtering cavity 610, the water filtered to remove the thread scraps enters the filtering mechanism 620 and flows out through water outlet connector 621. The filtered thread scraps are attached to the outer surface of the filtering mechanism 620. By driving the filtering mechanism 620 to rotate, the thread scraps can be detached and discharged through the discharge outlet 6103 with the water in the filtering cavity 610, thereby realizing the self-cleaning function of the filtering device 600 without requiring manual cleaning by a user.

The filtering mechanism 620 is supported by the first bearing 631 and the second bearing 632 at both ends, so that the filtering mechanism 620 can rotate smoothly and stably in the filtering cavity 610. At the same time, the first bearing 631 and the second bearing 632 are prevented from coming into contact with water by the arrangement of the first sealing member 641, the second sealing member 642 and the third sealing member 643, thus avoiding failure of both.

The above description is only preferred embodiments of the present disclosure, and is not intended to limit the present disclosure in any way. Although the present disclosure has been disclosed in the preferred embodiments, it is not intended to limit the present disclosure. Any technician familiar with this patent can make some changes or modifications to equivalent embodiments with equivalent changes by using the above-mentioned suggestive technical contents without departing from the scope of the technical solution of the present disclosure. However, any simple amendments, equivalent changes and modifications made to the above embodiments according to the technical essence of the present disclosure without departing from the contents of the technical solution of the present disclosure are still within the scope of the solution of the present disclosure.

The invention claimed is:

1. A washing machine, including:

a water container;

a filtering device, communicating with the water container and configured to filter water in the water container, wherein the filtering device is provided with a discharge outlet for discharging filtered impurities outward; and a recovery device, separately arranged with the filtering device and communicating with the discharge outlet of the filtering device for collecting the discharged filtered impurities;

the recovery device includes:

a housing, provided with a recovery chamber inside; and a filtering assembly, arranged within the recovery chamber and dividing the recovery chamber into a first chamber and a second chamber;

wherein:

the discharge outlet of the filtering device communicates with the first chamber, and sewage carrying the filtered impurities enters the first chamber, is filtered by the filtering assembly and enters the second chamber, and the filtered impurities are collected in the first chamber, the housing is insertably/extractably mounted on the washing machine, and an upper side of the housing is provided with an opening.

2. The washing machine according to claim 1, wherein, a discharge pipeline is included, and one end of the discharge pipeline is connected with the discharge outlet of the filtering device, and an other end of the discharge pipeline communicates with the recovery device.

3. The washing machine according to claim 2, wherein, the filtering device includes:

a filtering cavity, the discharge outlet is arranged thereon, and a water inlet communicating with the water container is further arranged thereon; and a filtering mechanism, rotatably arranged within the filtering cavity and dividing inside of the filtering cavity into an outer cavity and an inner cavity;

the water inlet and the discharge outlet both communicate with the outer cavity, and the discharge outlet is arranged at a bottom part of the filtering cavity and is connected with the discharge pipeline.

4. The washing machine according to claim 1, wherein, the filtering assembly includes a filter screen horizontally arranged at a certain height within the recovery chamber, and the filter screen divides the recovery chamber into the first chamber and the second chamber distributed up and down.

5. The washing machine according to claim 1, wherein it includes a circulation filtering pipeline, a water inlet end and a water outlet end of which respectively communicating with the water container, and a circulation pump being arranged thereon;

the filtering device, arranged on the circulation filtering pipeline, provided with a discharge outlet for discharging filtered impurities outward;

the recovery device, communicating with the discharge outlet of the filtering device through a discharge pipeline; and a discharge control valve, arranged on the discharge pipeline, and configured to control on-off of the discharge pipeline.

6. The washing machine according to claim 5, wherein, a three-way structure is arranged between a water outlet end of the circulation pump and a water outlet end of the circulation filtering pipeline, and the three-way structure is connected with an outward discharge pipeline for discharging water to the outside of the washing machine; and the filtering device is arranged between the three-way structure and the water outlet end of the circulation filtering pipeline.

7. The washing machine according to claim 6, wherein, the three-way structure includes a switching mechanism for controlling one of the filtering device and the outward discharge pipeline to communicate with a water outlet end of the circulation pump.

8. The washing machine according to claim 6, wherein, a water return control valve is arranged between the filtering device and the water outlet end of the circulation filtering pipeline, which is configured to control on-off of the circulation filtering pipeline.

9. A control method of the washing machine according to claim 5, wherein, performing a discharge operation, including: opening the discharge control valve to open the discharge pipeline, and discharging the sewage carrying the filtered impurities in the filtering device into the recovery device.

10. The control method of the washing machine according to claim 9, wherein, performing a circulation filtering operation: closing the discharge control valve, turning on the circulation pump to introduce water in the water container into the circulation filtering pipeline, and making the water return to the water container after removing the filtered impurities by the filtering device.

11. The control method of the washing machine according to claim 9, wherein, a water return control valve is arranged between the filtering device and the water outlet end of the circulation filtering pipeline for controlling on-off of the circulation filtering pipeline;

the control method also includes a self-cleaning operation, including: closing the water return control valve, opening the discharge control valve to open the discharge pipeline, turning on the circulation pump to introduce the water in the water container into the filtering device, and discharging the water to the recovery device after cleaning the filtering device.

12. The washing machine according to claim 1, further including:

a water container water outlet being arranged on the water container;

a drainage waterway, a water inlet end of which being connected with the water container water outlet and configured to discharge water to outside of the washing machine;

a discharge pipeline, wherein a water inlet end of which is connected with the discharge outlet, and a water outlet end of which is connected with the drainage waterway; and a discharge control valve, arranged on the discharge pipeline and configured to control on-off of the discharge pipeline.

13. The washing machine according to claim 12, wherein, when the discharge control valve is opened, the discharge pipeline is unidirectionally opened from the discharge outlet to the drainage waterway.

14. The washing machine according to claim 13, wherein, the discharge pipeline includes a sewage discharge section which vertically extends upward for a certain length, and an upper end of the sewage discharge section is connected with the drainage waterway; the discharge control valve is arranged on the sewage discharge section.

15. The washing machine according to claim 14, wherein, the drainage waterway includes an upper drainage pipe extending vertically for a certain length, in which the drainage water flow flows upwards; the upper end of the sewage discharge section is connected with a lower end of the upper drainage pipe.

16. The washing machine according to claim 12, wherein, a circulation pump is arranged between the water container water outlet and a water outlet end of the discharge pipeline on the drainage waterway, and a switching device is arranged between a water outlet end of the circulation pump and the water outlet end of the discharge pipeline; and the switching device is connected with the filtering device, and controls one of a water inlet of the filtering device and the water outlet end of the drainage waterway to communicate with the water outlet end of the circulation pump.

17. The washing machine according to claim 16, wherein, a bottom part of the water container is provided with a water container water return port, and the filtering device is provided with a filtered water outlet for discharging the filtered water; the filtered water outlet communicates with the water container water return port through a water return pipeline, and a water return control valve for controlling on-off of the water return pipeline is arranged on the water return pipeline.

18. The washing machine according to claim 17, wherein, the water container water outlet and the water container water return port are both arranged on a container wall of the water container and are located at the bottom part of the water container.

19. The washing machine according to claim 18, wherein, the water container water outlet is arranged close to a container opening of the water container, and the water container water return port is arranged close to a container bottom of the water container; or the water container water outlet is arranged near the container bottom of the water container, and the water container water return port is arranged near the container mouth of the water container.

* * * * *